US008459887B2

(12) United States Patent
Yamashita et al.

(10) Patent No.: US 8,459,887 B2
(45) Date of Patent: Jun. 11, 2013

(54) CUTTER DEVICE AND PRINTING APPARATUS

(75) Inventors: Norihiro Yamashita, Shiojiri (JP); Eiji Kumai, Hata-machi (JP); Yuta Tsukada, Shiojiri (JP); Shoji Akatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 473 days.

(21) Appl. No.: 12/398,745

(22) Filed: Mar. 5, 2009

(65) Prior Publication Data

US 2009/0226236 A1 Sep. 10, 2009

(30) Foreign Application Priority Data

Mar. 7, 2008 (JP) ..... 2008-058201

(51) Int. Cl.
*B41J 15/00* (2006.01)

(52) U.S. Cl.
USPC ..... 400/621

(58) Field of Classification Search
USPC ..... 400/621
See application file for complete search history.

(56) References Cited

U.S. PATENT DOCUMENTS

| | | | | |
|---|---|---|---|---|
| 5,042,349 | A | 8/1991 | Komatsu | |
| 5,791,218 | A | 8/1998 | Saito et al. | |
| 5,937,723 | A | 8/1999 | Kirikoshi et al. | |
| 6,807,888 | B1 | 10/2004 | Kiyohara et al. | |
| 2001/0000463 | A1* | 4/2001 | Kaya | 400/621 |
| 2003/0010169 | A1 | 1/2003 | Nagasawa | |
| 2006/0007292 | A1* | 1/2006 | Ohmori et al. | 347/104 |
| 2008/0061491 | A1 | 3/2008 | Nakashima | |
| 2009/0232577 | A1* | 9/2009 | Kumai | 400/621 |

FOREIGN PATENT DOCUMENTS

| | | |
|---|---|---|
| CN | 101088770 | 12/2007 |
| GB | 2 299 778 | 10/1996 |
| JP | 02-250793 | 10/1990 |
| JP | 06-198989 | 7/1994 |
| JP | 07-024782 | 1/1995 |
| JP | 07-100791 | 4/1995 |
| JP | 08-150593 | 6/1996 |
| JP | 09-019888 | 1/1997 |
| JP | 09-117891 | 5/1997 |
| JP | 09-254083 | 9/1997 |

(Continued)

OTHER PUBLICATIONS

U.S. Appl. No. 12/400,941, Sep. 12, 2011, Office Action.

(Continued)

*Primary Examiner* — Michael G Lee
*Assistant Examiner* — Matthew Mikels
(74) *Attorney, Agent, or Firm* — Workman Nydegger

(57) ABSTRACT

A cutter device includes a cutter configured to cut a material to be cut; a carriage having a cutter and moving in a widthwise direction with respect to a feeding direction of the material to be cut; and a guide unit configured to guide the carriage in the widthwise direction and, assuming that the movement of the carriage when the cutter cuts the material to be cut is an outward route, a homeward route of the cutter of the carriage is different from the outward route of the cutter, and is shifted from the outward route toward one material to be cut which moves first in the direction away from the other material to be cut in the feeding direction immediately after the cutting from between the materials to be cut divided into two parts.

8 Claims, 25 Drawing Sheets

FOREIGN PATENT DOCUMENTS

| | | |
|---|---|---|
| JP | 10-109292 | 4/1998 |
| JP | 2000-158735 | 6/2000 |
| JP | 2001-071293 | 3/2001 |
| JP | 2003-25661 | 1/2003 |
| JP | 2003-103495 | 4/2003 |
| JP | 2003-260830 | 9/2003 |
| JP | 2003-266832 | 9/2003 |
| JP | 2004-122676 | 4/2004 |
| JP | 2004-202628 | 7/2004 |
| JP | 2005-219178 | 8/2005 |
| JP | 2005-238785 | 9/2005 |
| JP | 2006-168154 | 6/2006 |
| JP | 2007-022070 | 2/2007 |

OTHER PUBLICATIONS

U.S. Appl. No. 12/400,941, Apr. 11, 2012, Final Office Action.

* cited by examiner

CUTTER DEVICE AND PRINTING APPARATUS

BACKGROUND

1. Technical Field

The present invention relates to a cutter device including a cutter configured to cut a material to be cut, a carriage having the cutter and moving in a widthwise direction with respect to a feeding direction of the material to be cut, and a guide unit configured to guide the carriage in the widthwise direction and a printing apparatus having the cutter device.

In this application, the printing apparatus includes various types such as ink jet printers, wire dot printers, laser printers, line printers, copying machines, facsimile machines.

2. Related Art

In the related art, as shown in JP-A-2003-260830, a printing apparatus which is configured to set a roll paper includes a cutting unit as a cutter device. Then, the cutting unit includes a cuter motor as a drive source, a cutter unit configured to move in the widthwise direction of the roll paper, and a guide rail configured to guide the cutter unit in the widthwise direction. The cutter unit includes a cutter configured to cut the roll paper.

Therefore, the roll paper can be cut after having set the roll paper by a user and before and after printing.

However, a cutter blade provided in the cutter unit passes the same route in an outward route for cutting the roll paper and a homeward route for returning back to its original position. Therefore, the cutter blade might come into contact with the roll paper which is already cut in the homeward route. Consequently, the cutter blade might cause wrinkles or damages on the already cut roll paper, which might hinder the movement of the cutter unit, so-called a cut paper jam might occur. Also, the cutter blade might cut the roll paper which is already cut again, that is, so-called duplex cutting might occur.

SUMMARY

An advantage of some aspects of the invention is to provide a cutter device which is able to prevent a cut paper jam and duplex cutting, and a printing apparatus having the cutter device.

According to a first aspect of the invention, there is provided a cutter device including a cutter configured to cut a material to be cut; a carriage having the cutter and moving in a widthwise direction with respect to a feeding direction of the material to be cut; and a guide unit configured to guide the carriage in the widthwise direction, in which assuming that the movement of the carriage when the cutter cuts the material to be cut is an outward route, a homeward route of the cutter of the carriage is different from the outward route of the cutter, and is shifted from the outward route toward one material to be cut which moves first in the direction away from the other material to be cut in the feeding direction immediately after the cutting from between the materials to be cut divided into two parts.

In this configuration, in the cutter device, the homeward route of the cutter of the carriage is different from the outward route of the cutter, and is shifted from the outward route toward one material to be cut which moves first in the direction away from the other material to be cut in the feeding direction immediately after the cutting from between the materials to be cut divided into two parts. In other words, in the homeward route, the carriage and the cutter are able to move along the routes further from the material to be cut immediately after having cut and being at rest in comparison with the routes in the outward route. Consequently, there is no risk of occurrence of so-called a jam caused by contact of the carriage with the material to be cut after being cut in the homeward route. In the homeward route, there is no risk of duplex cutting of the material to be cut by the cutter.

Preferably, the cutter includes a first cutter provided on the side of one surface of the material to be cut and a second cutter provided on the side opposite from the side of the one surface of the material to be cut, and shears the material to be cut by the cooperation of the first cutter and the second cutter.

In this configuration, the cutter includes the first cutter provided on the side of one surface of the material to be cut and the second cutter provided on the side opposite from the side of the one surface of the material to be cut, and shears the material to be cut by the cooperation of the first cutter and the second cutter.

Here, a configuration in which the first cutter retracts to the upper surface side as an example of the one surface side and the second cutter retracts to the lower surface side as an example of the opposite surface side respectively is contemplated. However, the structure is extremely complicated. Also, relative positional accuracies of the first cutter and the second cutter for the shearing might not be maintained.

Therefore, in this configuration, since the carriage is moved integrally in one direction while maintaining the relative position between the first cutter and the second cutter, the simple configuration is achieved in comparison with the configuration in which the respective cutters retract respectively. In addition, the relative positional accuracy is maintained.

In other words, the configuration in which the routes in the homeward route are different from the routes in the outward route is specifically effective in the case of the configuration in which the cutter shears the material to be cut from one surface side and the opposite surface side.

Preferably, a clearance is formed between the carriage and the guide unit, and the cutter receives a force in one direction toward the upstream side or the downstream side in the feeding direction of the material to be cut on the basis of the cutting characteristic.

The term "cutting characteristic" here means an event that when the cutter proceeds to cut a roll paper as an example of the material to be cut, the cutter receives an action (force) from the roll paper in the direction orthogonal to the direction of travel of the cutter (upstream direction and downstream direction in the feeding direction).

In this configuration, the clearance is provided between the carriage and the guide unit, and the cutter receives a force in one direction toward the upstream side or the downstream side in the feeding direction of the material to be cut on the basis of the cutting characteristic. Therefore, the different routes are configured without adding a new member. Using the "cutting characteristic", the routes of the cutter may be differentiated in the outward route and the homeward route.

By the configuration in which the own weight of the carriages acts in the opposite direction from the "cutting characteristic" in the homeward route, the routes of the cutter is further reliably differentiated.

Needless to say, it is configured to allow the force on the basis of the cutting characteristic to resist the own weight of the carriage in the homeward route.

Preferably, the guide unit includes a first rail member configured to guide the carriage in the outward route and a second rail member configured to guide the carriage in the homeward route, and the first rail member and the second rail member are configured into a loop shape.

In this configuration, the guide unit includes the first rail member configured to guide the carriage in the outward route and the second rail member configured to guide the carriage in the homeward route are provided, and the first rail member and the second rail member are configured into a loop shape. Therefore, the homeward route of the cutter is differentiated from the outward route further reliably.

Preferably, a clearance is formed between the carriage and the guide unit, and an urging unit configured to urge the carriage in one direction toward the upstream side or the downstream side in the feeding direction in only one of the outward route and the homeward route is provided.

In this configuration, the clearance is formed between the carriage and the guide unit, and the urging unit configured to urge the carriage in one direction toward the upstream side or the downstream side in the feeding direction in only one of the outward route and the homeward route is provided. Therefore, the different route may be configured only by adding the urging unit.

The urging unit here includes, for example, a magnet configured to generate a magnetic force and a spring or the like configured to generate an urging force.

Preferably, a clearance is provided between the carriage and the guide unit, and an urging unit configured to urge the carriage in one direction toward the upstream side or the downstream side in the feeding direction in the outward route and urge the carriage in the direction opposite from the one direction in the homeward route is provided.

In this configuration, the clearance is provided between the carriage and the guide unit, and an urging unit configured to urge the carriage in one direction toward the upstream side or the downstream side in the feeding direction in the outward route and urge the carriage in the direction opposite from the one direction in the homeward route is provided. Therefore, the different routes are configured only by adding the urging unit. In addition, since the carriage is urged in the opposite directions in the outward route and the homeward route, the different routes are configured further reliably than the configuration describe above.

Preferably, the urging means includes a magnetic force generating portion configured to generate a magnetic force, and shifts the posture of the carriage or the position in the feeding direction.

In this configuration, the urging means includes the magnetic force generating portion configured to generate the magnetic force, and shifts the posture of the carriage or the position in the feeding direction. Therefore, the magnetic force can easily be switched in the outward route and the homeward route. Since the magnetic force generating portion may be provided on either one of the side of the base portion of the cutter device or on the side of the carriage thereof, flexibility in layout is improved.

Here, when the spring is provided only on the side of the base portion as the urging unit, it is necessary to bring one end of the spring into contact with the carriage. Therefore, a new frictional force is generated between the spring and the carriage.

In this configuration, even when the magnetic force generating portion is provided on the side of the base portion, it is not necessary to bring the magnetic force generating portion into contact with the carriage. Therefore, a new frictional force is not generated. As a consequence, it is effective since there is no risk of increase in load of the movement of the carriage in the widthwise direction in comparison with the case in which the spring is provided on the side of the base portion.

According to a second aspect of the invention, there is provided a printing apparatus including a feeder configured to feed a printing medium, a printing unit configured to carry out a printing job on the printing medium fed from the feeder by a printhead, and a cutting unit configured to cut the printed printing medium, in which the cutting unit includes a cutter device of any one of modes described above.

In this configuration, the cutting unit includes the cutter device of any one of modes described above. Therefore, the same effects and advantages as in any one of the modes described above are achieved.

BRIEF DESCRIPTION OF THE DRAWINGS

The invention will be described with reference to the accompanying drawings where like numbers reference like elements.

DESCRIPTION OF EXEMPLARY EMBODIMENTS

Referring now to drawings, embodiments of the invention will be described below.

Figure 1:
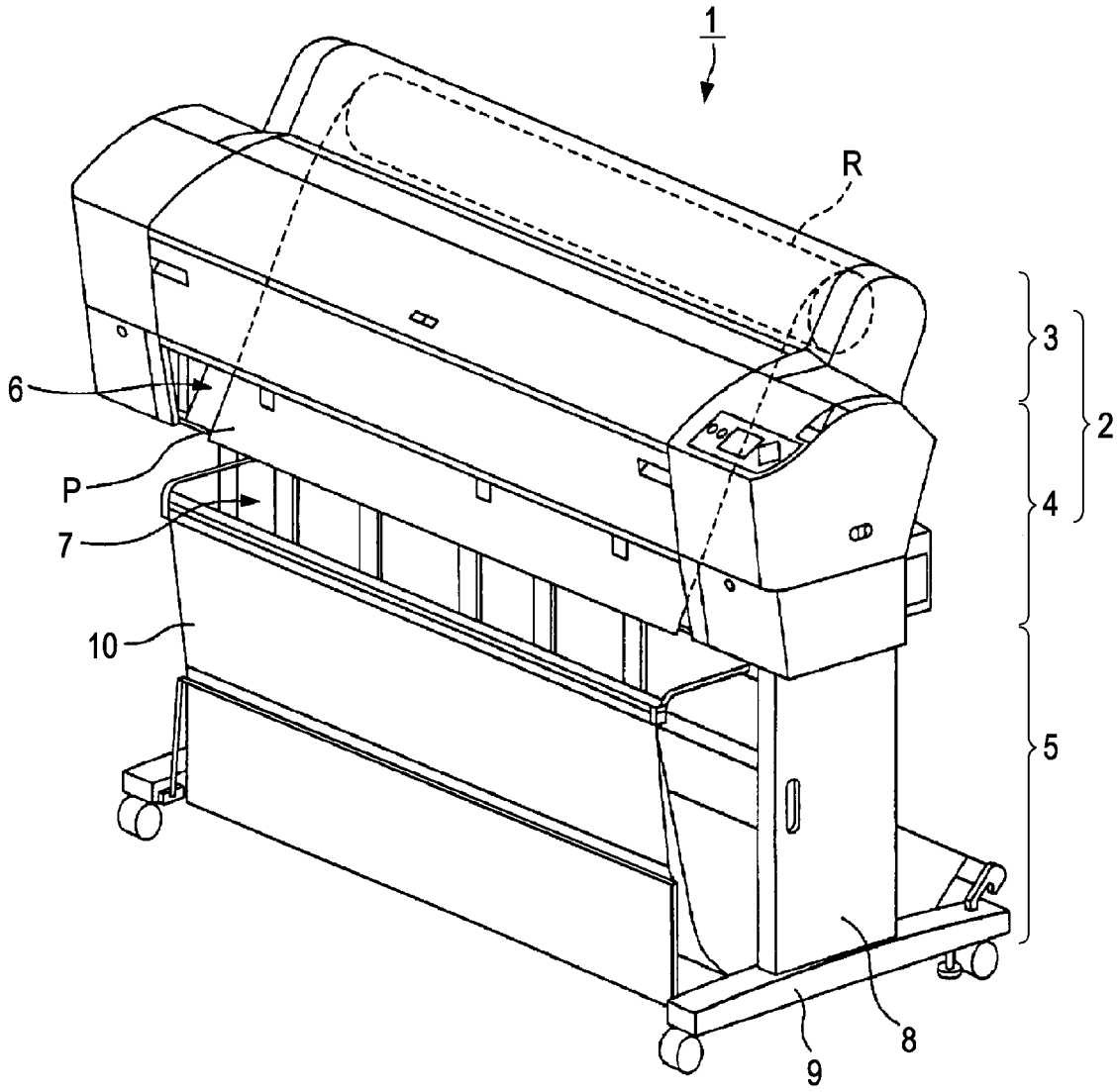
FIG. 1 is an appearance perspective view of a printer according to an embodiment of the invention.

FIG. 1 is an appearance perspective view of an ink jet printer (hereinafter referred to as "printer") 1 as an example of a "printing apparatus" or a "liquid ejecting apparatus" according to the invention.

The liquid ejecting apparatus here includes not only printing apparatuses such as ink jet printing apparatuses which carry out printing on printing materials by ejecting ink on the printing materials such as printing papers from a printhead as a liquid ejecting head, copying machines and facsimile machines, but also apparatuses which eject liquid for specific applications instead of ink from a liquid ejecting head which corresponds to the printhead described above onto ejecting materials which correspond to the printing materials to cause the liquid to be adhered to the ejecting materials.

In addition, as the liquid ejecting head, a color material ejecting head used for manufacturing color filters such as liquid crystal displays, an electrode material (conductive paste) ejecting head used for forming electrodes of organic EL displays or surface emission-type displays (FED) or the like, a biological organic substance ejecting head used for manufacturing biochips, and a sample ejecting head for ejecting samples as a precision pipette are exemplified.

The printer 1 is a large size printer which supports ejected media having a relatively large width or a roll paper P as a printing medium of, for example, A0 size or B0 size in JIS standard, including a body portion 2 having a roll paper feeding unit 3 and a print executing unit 4 and a discharged paper receiving unit 5.

The body portion 2 is provided on the top of supporting columns 8 provided upright on a base 9, and includes a discharge port 6 for discharging the roll paper P after having printed obliquely downward. An opening 7 of a stacker 10 is positioned below the discharge port 6, and the roll paper P after having printed is discharged from the discharge port 6 toward the opening 7, and is received by the stacker 10.

The roll paper feeding unit 3 is configured to accommodate a roll paper roll (hereinafter referred to as a "roll") R, and the roll paper P is delivered from the roll R, and is supplied obliquely downward to the print executing unit 4 for executing the printing job. Then the roll R is set to a roll paper holder (not shown). When feeding the roll paper, the roll paper P is fed toward downstream by the roll paper holder being driven to rotate by a spindle motor (not shown) as a roll driving unit.

The print executing unit 4 includes a printhead 12 (see FIG. 2 and FIG. 3) as a liquid ejecting unit or a printing unit configured to discharge (eject) ink as liquid on the roll paper P, a platen 11 (see FIG. 2 and FIG. 3) arranged to oppose the printhead 12, and a transporting drive roller (transporting roller) (not shown) which is provided on the upstream side of the printhead 12 and transports the roll paper P toward the downstream side, and a transporting driven roller (not shown) which is in press-contact thereto and driven to rotate.

The printhead 12 is provided on a carriage (not shown), and the carriage is moved in a primary scanning direction by receiving a power from a motor, not shown, while being guided by a guide shaft (not shown) extending in the scanning direction (primary scanning direction) of the printhead 12 and a guide panel (not shown) extending in the primary scanning direction in the same manner.

An air suction unit 13 (see FIG. 2 and FIG. 3) as a paper suction unit is provided on the downstream side from the printhead 12, and the roll paper P is placed under control so as not to be lifted by the air suction unit 13 (see FIG. 2 and FIG. 3) on the downstream side of the printhead 12, so that lowering of the print quality due to the lifting of the roll paper P is prevented.

Figure 2:
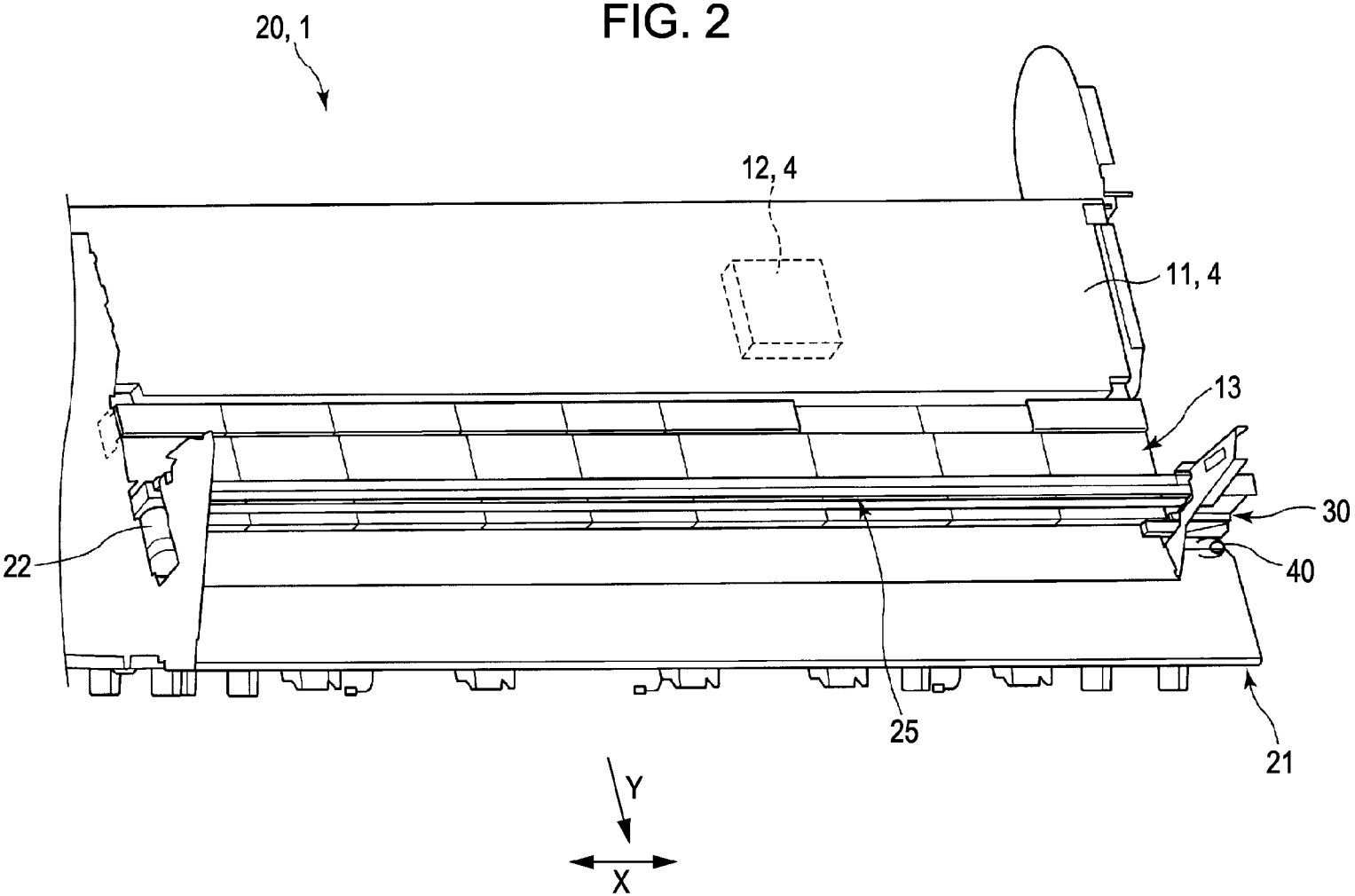
FIG. 2 is a schematic perspective view of a cutting unit according to the embodiment of the invention.
Figure 3:
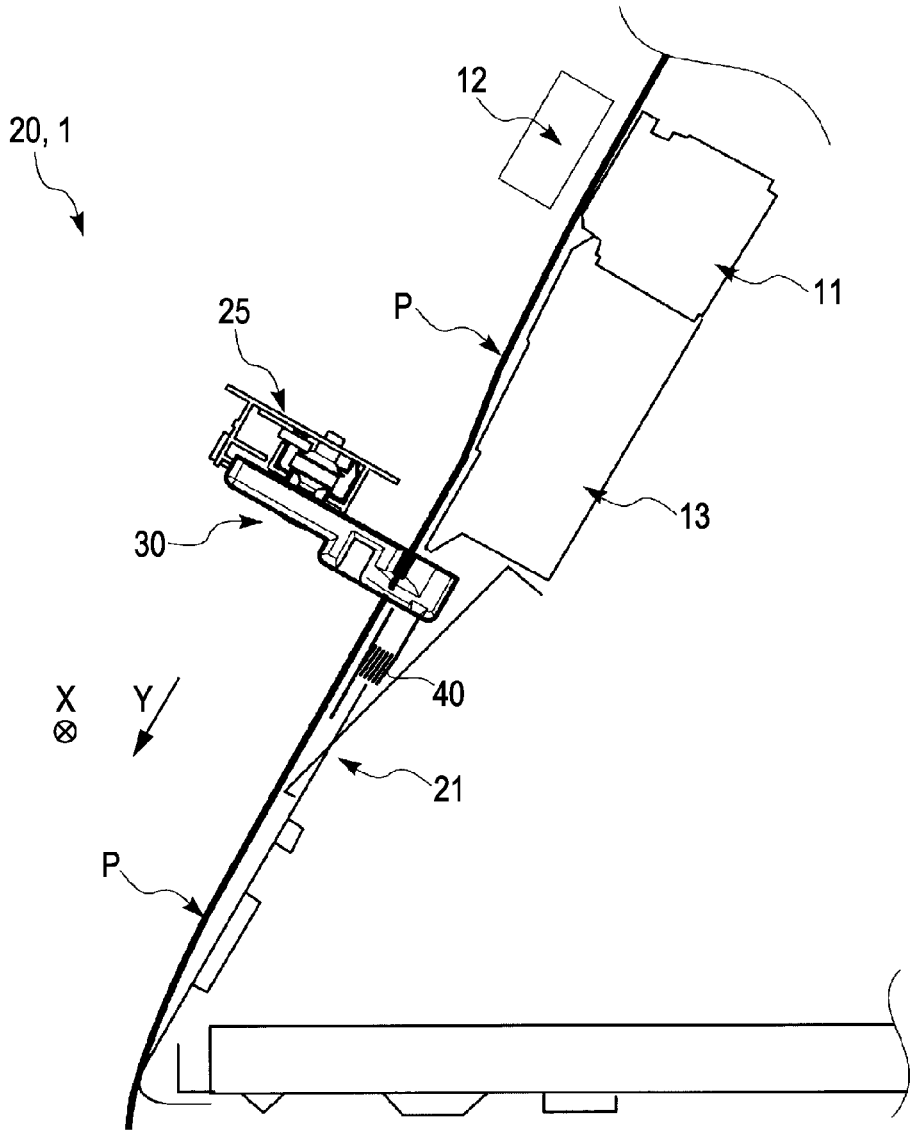
FIG. 3 is a schematic perspective view of the cutting unit according to the embodiment of the invention.

FIG. 2 is a schematic perspective view of a cutting unit according to the embodiment of the invention. FIG. 3 is a schematic side view of the cutting unit according to the embodiment of the invention.

As shown in FIG. 2 and FIG. 3, the platen 11 is provided in the print executing unit 4 of the printer 1. Then, the air suction unit 13 and a cutting unit 20 configured to cut the roll paper P are provided on the downstream side of the platen 11 in terms of the feeding direction.

The cutting unit 20 includes a base portion 21, a cutter motor 22, a guide rail 25, a cutter unit 30, and a torsion coil spring 40 as an example of an urging unit. Among others, the cutter motor 22 is provided so as to be capable of transmitting the power to the cutter unit 30 via a belt 23 (see FIG. 5) wound around a pulley 24 (see FIG. 5). The guide rail 25 is configured to guide the cutter unit 30 in a widthwise direction X of the roll paper P.

Furthermore, the cutter unit 30 includes a first cutter 37, and a second cutter 38 (see FIG. 4, FIG. 5, FIG. 7 and FIG. 8) as described later, so as to be capable of shearing the roll paper P. The torsion coil spring 40 is fixed to the base portion 21 on the side of the first column (right side in FIG. 2) in the widthwise direction X so as to urge the cutter unit 30 positioned on the side of the first column to the upstream side in terms of the feeding direction.

In this embodiment, the cutter unit 30 is provided so as to shear the roll paper P while moving from the side of the first column to the side of the eightieth column.

Figure 4:
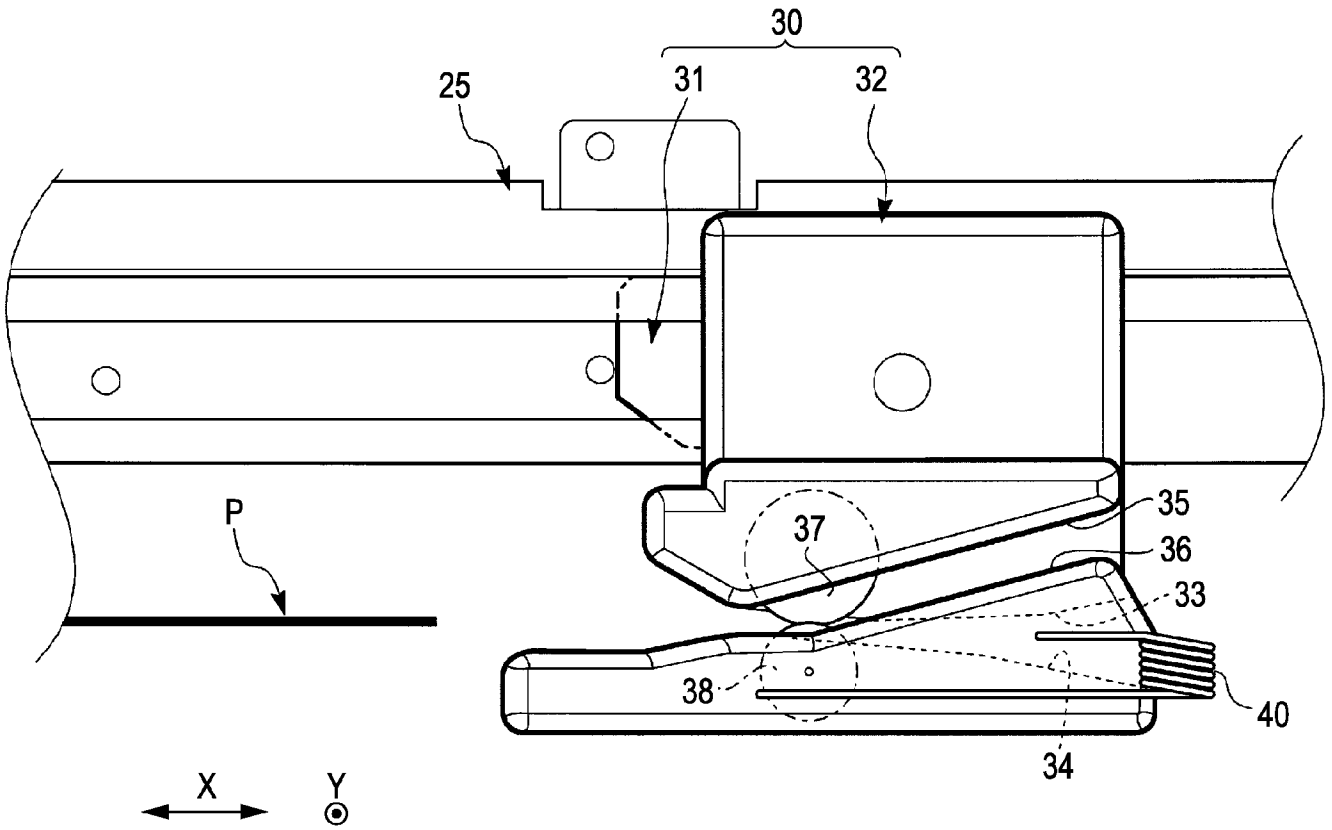
FIG. 4 is a front view showing a cutter unit according to the embodiment of the invention.
Figure 5:
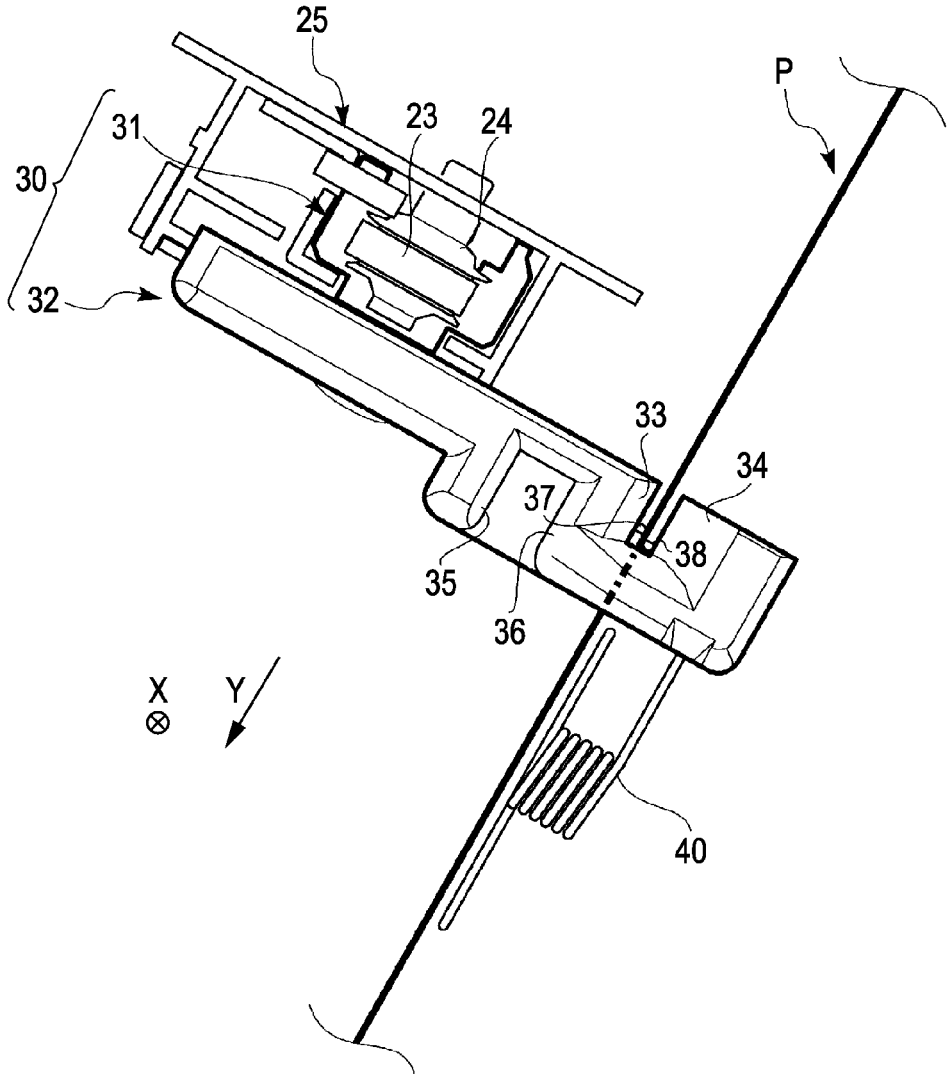
FIG. 5 is a side view showing the cutter unit according to the embodiment of the invention.

FIG. 4 is a front view showing the cutter unit according to the embodiment of the invention. FIG. 5 is a side view of FIG. 4.

As shown in FIG. 4 and FIG. 5, the cutter unit 30 includes a slider portion 31 and a cutter carriage 32. Among others, the slider portion 31 is provided so as to slide inside the guide rail 25. The cutter carriage 32 holds the first cutter 37 and the second cutter 38, and is configured integrally with the slider portion 31.

The first cutter 37 and the second cutter 38 here are provided so as to shear the roll paper P in cooperation with each other. More specifically, the first cutter 37 is provided on the side of a printing surface (front surface) side of the roll paper P and on the upstream side from the second cutter 38 in terms of the feeding direction. In contrast, the second cutter 38 is provided on the side of a surface opposite from the printing surface (back surface) of the roll paper P and on the downstream side from the first cutter 37 in terms of the feeding direction.

Provided on the upstream side of the cutter unit 30 in terms of the feeding direction are a first inclined portion 33 and a second inclined potion 34 for guiding the sheared roll paper P on the upstream side. Here, the second inclined potion 34 is formed so that the first column side, which is the right side in FIG. 4, is inclined slightly downward with respect to the widthwise direction X.

In contrast, provided on the downstream side of the cutter unit 30 in terms of the feeding direction are a third inclined portion 35 and a fourth inclined potion 36 for guiding the sheared roll paper P on the downstream side. The third inclined portion 35 and the fourth inclined portion 36 here are inclined so that the side of the first column, which is the right side in FIG. 4, is inclined upward with respect to the widthwise direction X.

The direction of inclination of the first inclined portion 33 to the fourth inclined portion 36 are determined by the phases of the first cutter 37 and the second cutter 38. More specifically, when the roll paper P is sheared, the sheared roll paper P on the upstream side is pressed downward (the direction from the front surface to the back surface of the roll paper P) by the first cutter 37. Therefore, the first inclined portion 33 and the second inclined potion 34 are able to guide the sheared roll paper P on the upstream side according to the pressed direction.

In contrast, when the roll paper P is sheared, the sheared roll paper P on the downstream side is pressed upward (in the direction from the back surface to the front surface of the roll paper P) by the second cutter 38. Therefore, the third inclined portion 35 and the fourth inclined portion 36 are able to guide the sheared roll paper P on the downstream side according to the pressed direction. The third inclined portion 35 here is inclined to an extent such that the front surface of the printed roll paper P does not come into contact with the third inclined portion 35. That is, the fourth inclined portion 36 is inclined to an extent such that the back surface of the printed roll paper P comes into contact with the fourth inclined portion 36.

The torsion coil spring 40 is provided so as to urge the cutter carriage 32 on the side where the first cutter 37 and the second cutter 38 are provided with reference to a position where the slider portion 31 and the guide rail 25 are in contact with each other.

Furthermore, the first cutter 37 is configured to be driven to rotate by the movement of the cutter unit 30 in the widthwise direction X.

Specifically, when the slider portion 31 slides, a roller (not shown) provided on the slider portion 31 rotates by the friction with respect to the guide rail 25. The power of the rotating roller is transmitted to the first cutter 37. At this time, the first cutter 37 rotates in the direction to wind the roll paper P (clockwise in FIG. 4). Therefore, the shearing of the roll paper P is further ensured. In other words, there is little risk of application of a force from the cutter unit 30 to the roll paper P in the widthwise direction X.

Figure 6A:
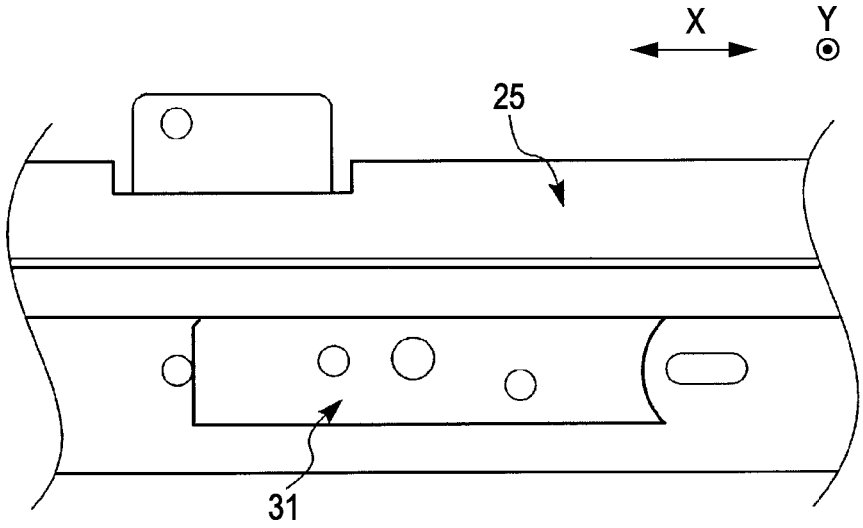
FIG. 6A is a drawing showing a slider portion and a guide rail.
Figure 6B:
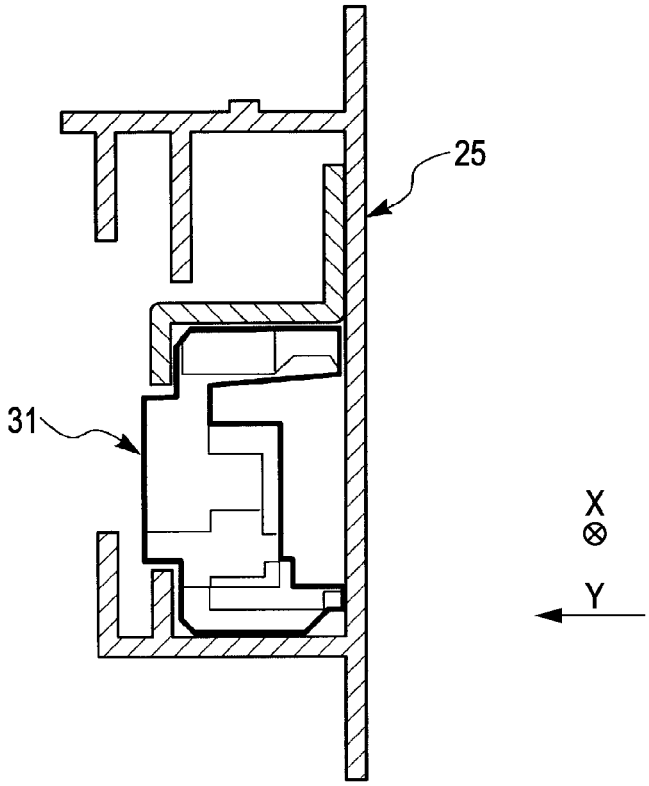
FIG. 6B is a drawing showing the slider portion and the guide rail.

FIGS. 6A and 6B show the slider portion and the guide rail. FIG. 6A is a front view. FIG. 6B is a side cross-sectional view.

In order to facilitate the understanding of the configuration, the cutter carriage is not shown in the drawing.

As shown in FIGS. 6A and 6B, the slider portion 31 is configured to slide inside the guide rail 25.

In order to allow the slider portion 31 to slide inside the guide rail 25, a small clearance, which is so-called rattling, is required between the slider portion 31 and the guide rail 25. If there is no rattling, the sliding load is significantly increased, which might hinder the sliding movement.

Therefore, the slider portion 31 is shiftable in posture with respect to the guide rail 25 by an extent corresponding to the rattling. Consequently, the entire cutter unit 30 is shiftable in posture with respect to the guide rail 25. In other words, the positions of the first cutter 37 and the second cutter 38 are shiftable in terms of a feeding direction Y.

Figure 7A:
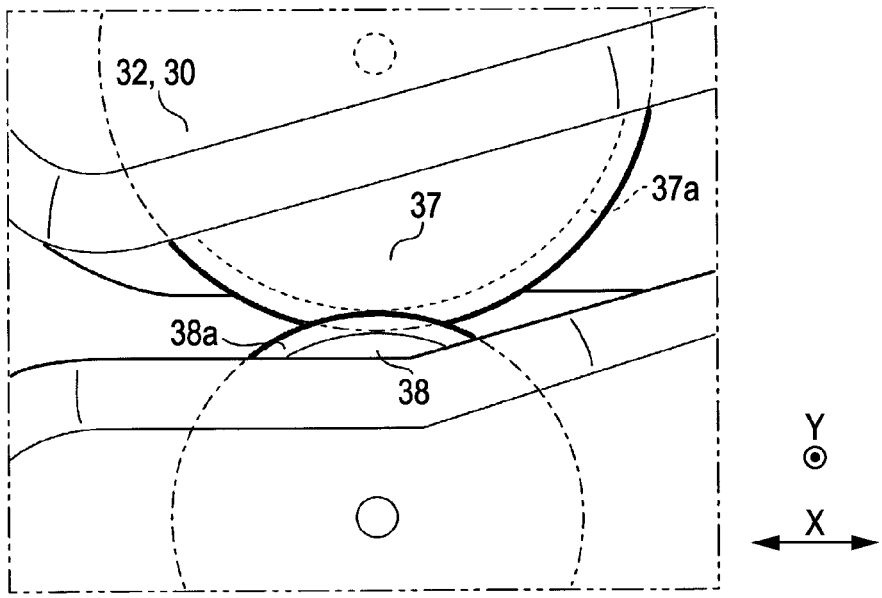
FIG. 7A is a drawing showing a positional relationship of cutter blades.
Figure 7B:
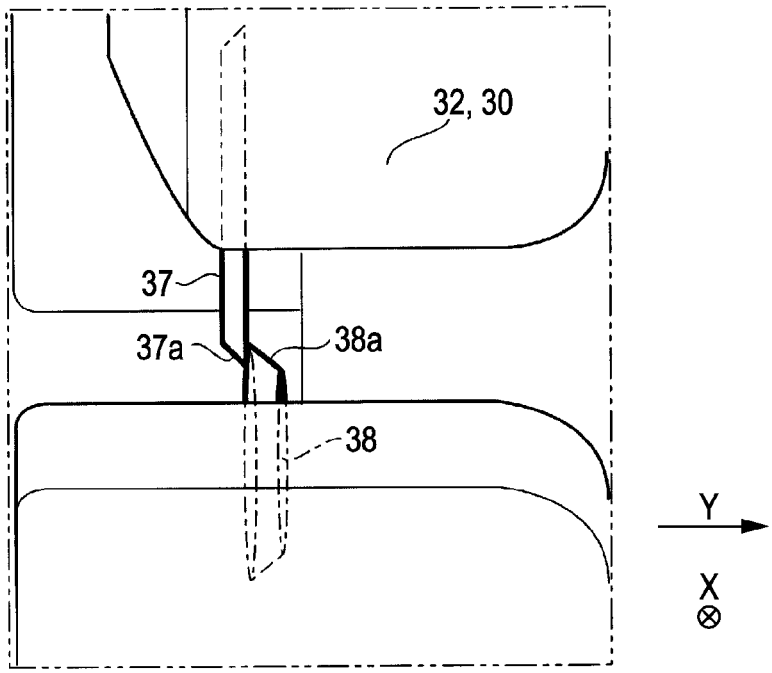
FIG. 7B is a drawing showing a positional relationship of the cutter blades.

FIGS. 7A and 7B show a positional relationship between the cutter blades. FIG. 7A is a front view viewed from the downstream side in terms of the feeding direction. FIG. 7B is a side view viewed from the side of the eightieth column in the widthwise direction.

Figure 8A:
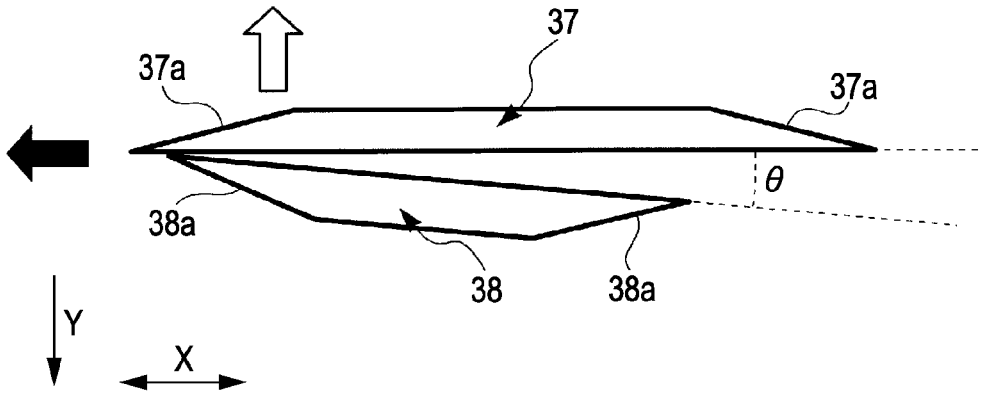
FIG. 8A is a drawing showing a principle of generation of a cutting characteristic.
Figure 8B:
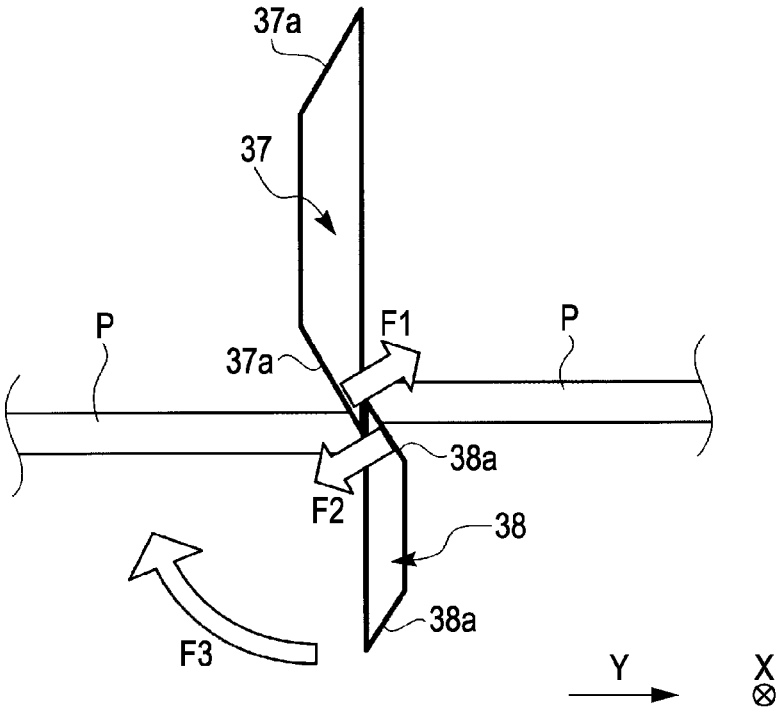
FIG. 8B is a drawing showing a principle of generation of the cutting characteristic.

FIGS. 8A and 8B are drawings showing a principle of generation of the cutting characteristic. FIG. 8A is a plan view viewed from the front surface side of the roll paper, that is, from above. FIG. 8B is a side view viewed from the side of the eightieth column in the widthwise direction.

As shown in FIGS. 7A and 7B, and FIGS. 8A and 8B, the first cutter 37 is formed with a first inclined surface 37*a* at the blade tip thereof.

The first inclined surface 37*a* here is inclined with respect to the posture of the first cutter 37.

In the same manner, the second cutter 38 is formed with a second inclined surface 38*a* at the blade tip thereof. The second inclined surface 38*a* is inclined with respect to the posture of the second cutter 38.

As shown in FIG. 8A, the posture of the first cutter 37 is parallel to the widthwise direction X. In contrast, the posture of the second cutter 38 is inclined with respect to the widthwise direction X by an angle θ. Specifically, the second cutter 38 is inclined so that the side of the eightieth column, that is, the leading end in the direction of travel (left side in FIG. 8A) is closer to the first cutter 37 than the side of the first column thereof by the angle θ in terms of the feeding direction Y.

In this application, the angle θ is referred to as "canting angle".

Therefore, when the cutter unit 30 is moved toward the side of the eightieth column (in the direction indicated by a black arrow in FIG. 8A) to shear the roll paper P, a force to travel to the upstream side in terms of the feeding direction by the second inclined surface 38*a* of the second cutter 38 is larger than a force to travel to the downstream side in terms of the feeding direction by the first inclined surface 37*a* of the first cutter 37.

Consequently, the force acts to cause the positions of the first cutter 37 and the second cutter 38 of the cutter unit 30 to be shifted toward the upstream side in terms of the feeding direction (in the direction indicated by a white arrow in FIG. 8A) during the shearing operation. This action is an example of the principle of the cutting characteristic.

As shown in FIG. 8B, the first inclined surface 37*a* of the first cutter 37 receives a force F1 from the distal end of the sheared roll paper P on the upstream side during the shearing operation. In the same manner, the second inclined surface 38*a* of the second cutter 38 receives a force F2 from the rear end of the sheared roll paper P on the downstream side. In other words, the forces act to cause the cutter unit 30 to rotate in the direction indicated by an arrow F3. In still other words, during the shearing operation, the forces act to cause the posture of the cutter unit 30 to be shifted about a contact point between the slider portion 31 and the guide rail 25.

Consequently, the force acts to cause the positions of the first cutter 37 and the second cutter 38 of the cutter unit 30 to be shifted toward the upstream side in terms of the feeding direction during the shearing operation. This action is an example of the principle of the cutting characteristic.

Although the first cutter 37 and the second cutter 38 are a round blade, that is, so-called a roller cutter in this embodiment, they are not limited thereto. Although the embodiment is configured to shear the roll paper P with the two cutters, the invention is not limited thereto.

Figure 9:
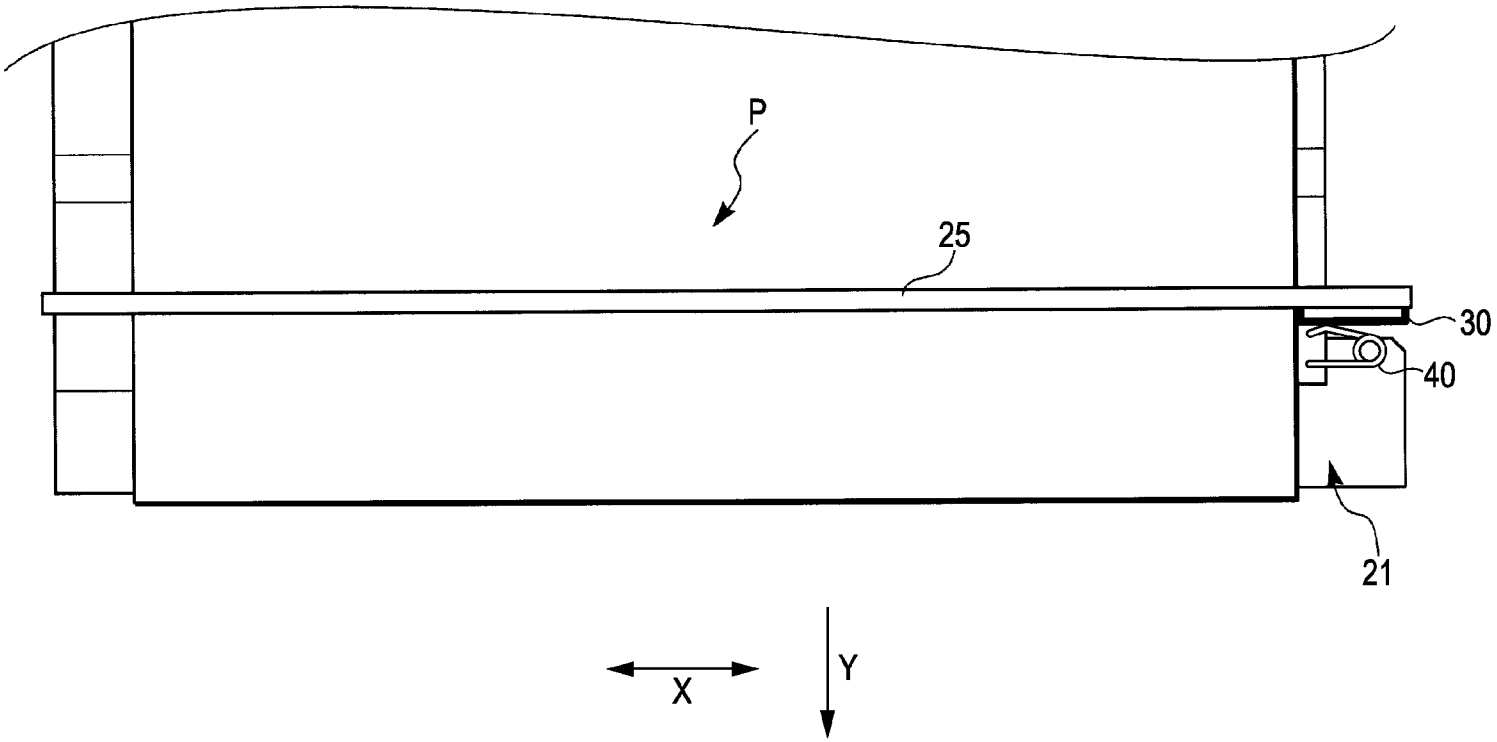
FIG. 9 is a front view showing the position of the cuter unit when shearing operation is started.

FIG. 9 is a front view showing the position of the cutter unit when starting the shearing.

As shown in FIG. 9, the cutter unit 30 is positioned on the side of the first column in the widthwise direction X.

A force acts on the cutter unit 30 so that the positions of the first cutter 37 and the second cutter 38 are shifted to the downstream side in terms of the feeding direction (lower side in FIG. 9) within the range of the rattling described above by its own weight.

In contrast, a force acts to cause the positions of the first cutter 37 and the second cutter 38 of the cutter unit 30 to be shifted toward the upstream side in terms of the feeding direction by the cutting characteristic demonstrated by the "canting angle" described above during the shearing operation.

In other words, the positions of the first cutter 37 and the second cutter 38 might be shifted before and after starting the shearing operation.

Therefore, the cutting unit 20 in this embodiment includes the torsion coil spring 40 which is an example of the urging unit. Specifically, it is configured to urge the cutter carriage 32 to the same side, which is the same as the direction in which the force acts on the basis of the cutting characteristic demonstrated by the "canting angle" or the like at least when the first cutter 37 and the second cutter 38 start cutting the roll paper P.

Therefore, the torsion coil spring 40 is able to shift the positions of the first cutter 37 and the second cutter 38 to the upstream side in terms of the feeding direction (upper side in FIG. 9) within the range of the rattling described above against the own weight described above. In other words, when the shearing operation is started, the first cutter 37 and the second cutter 38 can be positioned on the upstream side in terms of the feeding direction, which is the same as the direction in which the force acts on the basis of the cutting characteristic demonstrated by the "canting angle" or the like in the range of the rattling described above.

Then, the shearing operation is started before starting printing or after printing.

Figure 10:
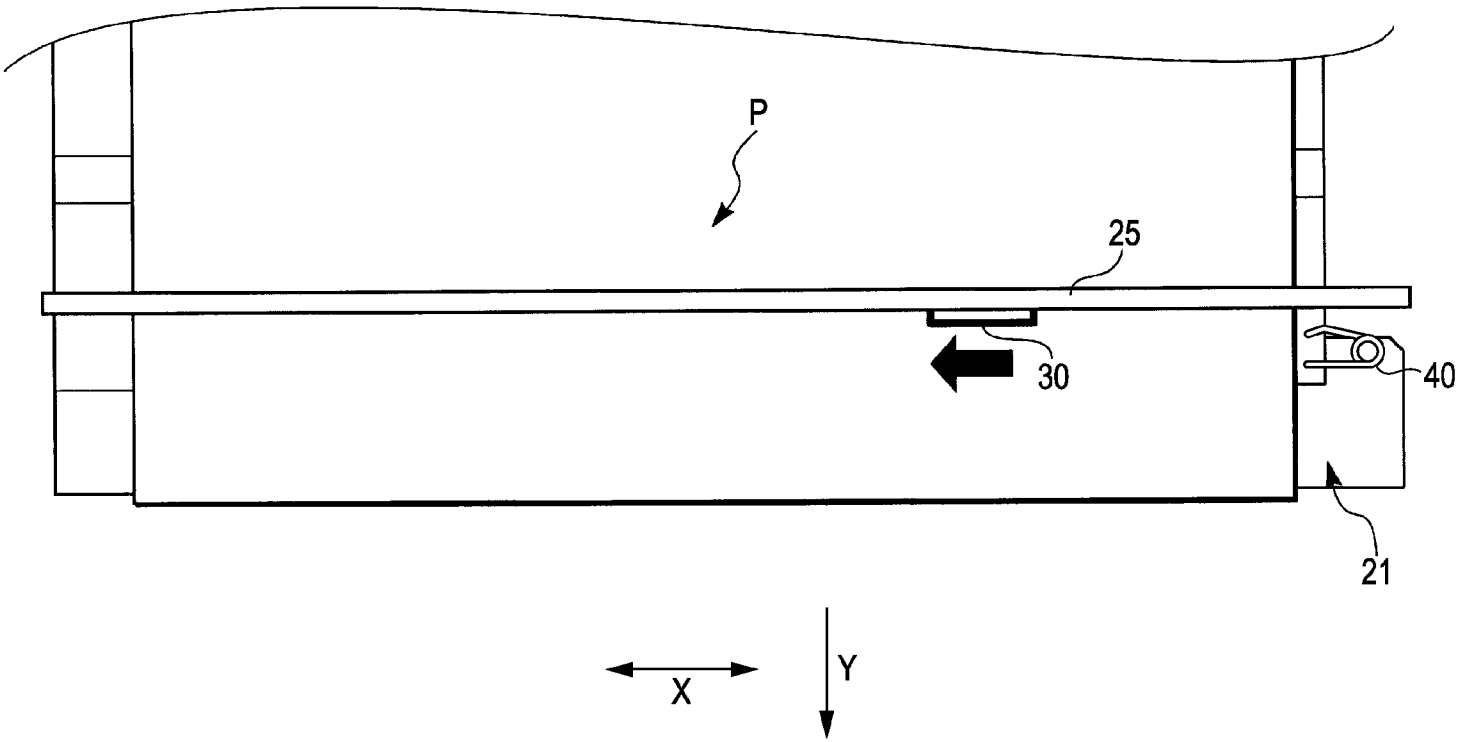
FIG. 10 is a front view showing the position of the cutter unit during the shearing operation (outward route).

FIG. 10 is a front view showing the position of the cutter unit during the shearing operation (outward route).

As shown in FIG. 10, when the cutter unit 30 is moved further toward the eightieth column side from the state shown in FIG. 9, the state during the shearing operation is achieved.

Now, when the shearing operation is started, that is, when the first cutter 37 and the second cutter 38 start to shear the roll paper P and receive the forces on the basis of the cutting characteristic of the "canting angle", the cutter unit 30 is configured to be moved away from the torsion coil spring 40.

Therefore, it is not necessary to consider a frictional load generated between the torsion coil spring 40 and the cutter unit 30 during the shearing operation. In other words, an urging force from the torsion coil spring 40 does not hinder the shearing operation of the cutter unit 30.

During the shearing operation, the positions of the first cutter 37 and the second cutter 38 of the cutter unit 30 are still shifted toward the upstream side in terms of the feeding direction within the range of the rattling on the basis of the cutting characteristic demonstrated by the "canting angle" or the like described above.

Then, the cutter unit 30 reaches an end P2 on the side of the eightieth column (see FIG. 11) of the roll paper P and the shearing operation is completed. Thereafter, the cutter unit 30 returns to its original position on the side of the first column.

Figure 11:
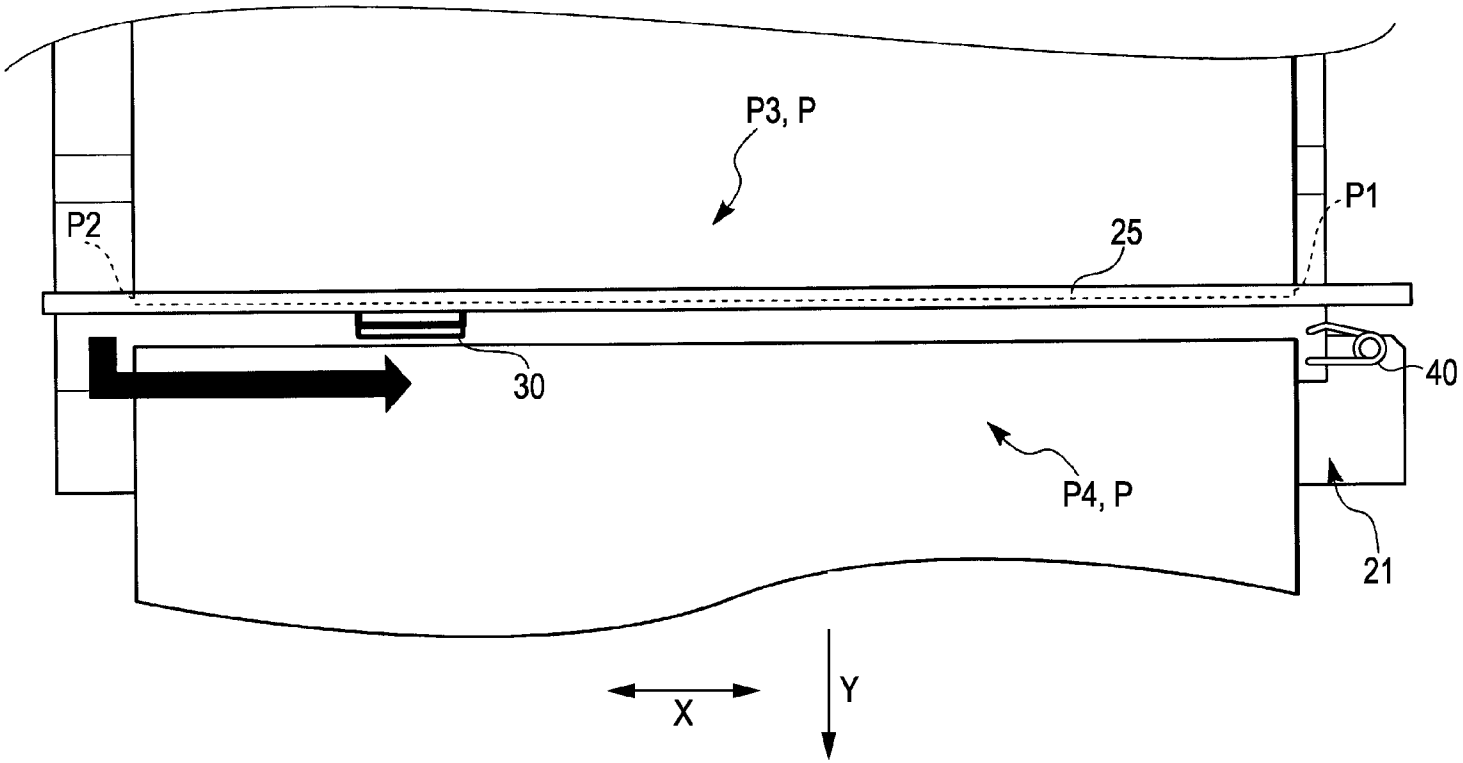
FIG. 11 is a front view showing the position and the posture of the cutter unit in a homeward route.
Figure 12:
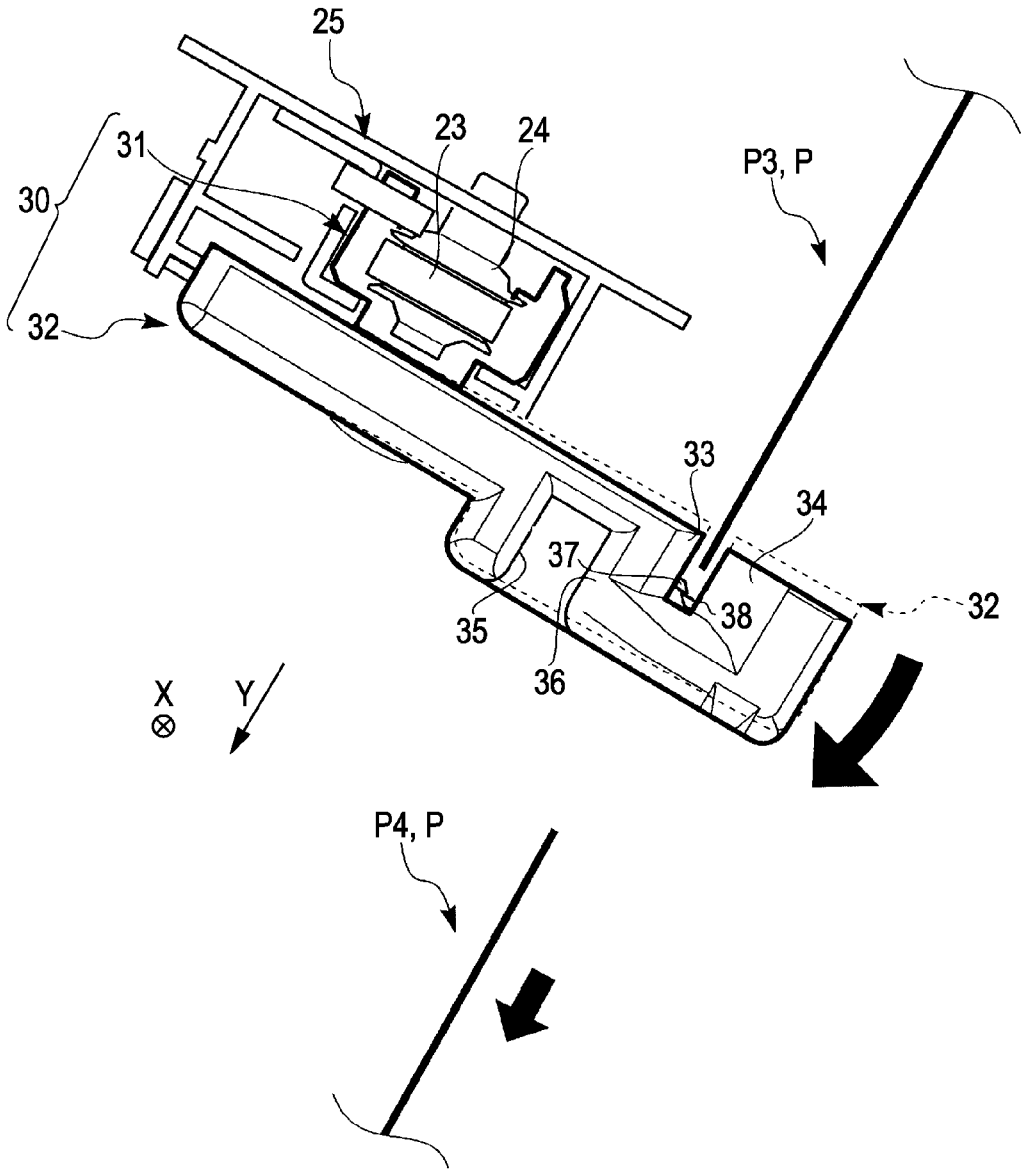
FIG. 12 is a side view showing the position and the posture of the cutter unit in the state shown in FIG. 11.

FIG. 11 is a front view showing the position and the posture of the cutter unit in a homeward route. FIG. 12 is a side view showing the position and the posture of the cutter unit in the state shown in FIG. 11.

As shown in FIG. 11, the distal end of the sheared roll paper P on the upstream side is aligned right straight by the urging force of the torsion coil spring 40 as an example of the urging unit. Specifically, the end P1 to start cutting and the end P2 on the opposite side of the roll paper P assume substantially the same position in terms of the feeding direction Y.

The torsion coil spring 40 is used as the example of the urging unit, the invention is not limited thereto. A configuration of urging by a leaf spring or a configuration of urging by a magnetic force of a magnet is also applicable. Although the torsion coil spring 40 is configured to move away from the cutter unit 30 after starting the shearing operation, it may urge the cutter unit 30 continuously.

As shown in FIG. 11 and FIG. 12, when the cutter unit 30 reaches the end P2 on the side of the eightieth column and shears the roll paper P to the end, the action on the basis of the cutting characteristic vanishes out.

A force acts on the cutter unit 30 by its own weight so that the positions of the first cutter 37 and the second cutter 38 are shifted to the downstream side in terms of the feeding direction (lower side in FIG. 11) within the range of the rattling described above.

Therefore, the posture of the cutter unit 30 is inclined clockwise in FIG. 12 about a contact point between the slider portion 31 and the guide rail 25. Consequently, the positions of the first cutter 37 and the second cutter 38 are shifted in the direction away from the downstream end of an upstream roll paper P3, that is, to the downstream side in terms of the feeding direction. Since the cutter unit 30 moves toward the side of the first column in this posture, there is no risk of contact of the first cutter 37 and the second cutter 38 with respect to the upstream roll paper P3 in the homeward route. In other words, the first cutter 37 and the second cutter 38 are prevented from cutting the upstream roll paper P3 in the homeward route, that is, from so-called duplex cutting.

When the cutter unit 30 reaches the end P2 on the side of the eightieth column and sheared the roll paper P completely, a downstream roll paper P4 moves toward downstream side in terms of the feeding direction by its own weight and is discharged.

When the cutter unit 30 returns to the side of the first column, it is guided by the inclined portion provided at the distal end of the torsion coil spring 40 and receives the urging force from the torsion coil spring 40 shown in FIG. 4, FIG. 5 and FIG. 9.

As described above, by utilizing the force generated by the "cutting characteristic", the outward routes of the first cutter 37 and the second cutter 38 for the shearing operation and the homeward routes of the first cutter 37 and the second cutter 38 for returning to the home positions are differentiated.

Here, by configuring the direction of the own weight of the cutter unit 30 which acts thereon to be the opposite direction from the direction in which the "cutting characteristic" acts, the outward route and the homeward route are differentiated further reliably.

Although the torsion coil spring 40 is provided on the side of the first column, it is just for making the sheared surface of the roll paper P aligned further right straight. Therefore, a configuration to differentiate the outward route and the homeward route can also be achieved even when the torsion coil spring 40 is not provided.

Although the downstream roll paper P4 in terms of the feeding direction is moved toward the downstream side in terms of the feeding direction, which is the direction to move away from the sheared upstream roll paper P3, after having sheared the roll paper P in the embodiment shown above, the invention is not limited thereto.

In other words, the upstream roll paper P3 may be moved toward the upstream side in terms of the feeding direction, which is the direction to move away from the sheared downstream roll paper P4 after having sheared the roll paper P. In such a case, needless to say, the homeward routes of the first cutter 37 and the second cutter 38 are positioned on the upstream side from the outward routes of the first cutter 37 and the second cutter 38 for the shearing operation in terms of the feeding direction.

The cutting unit 20 as a cutting apparatus in this embodiment includes the cutters (37, 38) configured to cut the roll paper P as an example of a material to be cut, the cutter unit 30 as a carriage having the cutters (37, 38) and moving in the widthwise direction X with respect to the feeding direction Y, which is the direction of feeding the roll paper P, and the guide rail 25 as a guide unit configured to guide the cutter unit 30 in the widthwise direction X, and is configured in such a manner that assuming that the movement of the cutter unit 30 when the cutters (37, 38) cut the roll paper P is the outward route, the homeward routes of the cutters (37, 38) of the cutter unit 30 are different from the outward routes of the cutters (37, 38), and are shifted from the outward routes toward the sheared downstream roll paper P4, which moves first in the direction away from the sheared upstream roll paper P3 in terms of the feeding direction Y immediately after the shearing, from between the roll papers P3 and P4 divided into two parts.

In this embodiment, the cutters (37, 38) are characterized in that the first cutter 37 provided on the side of the one surface of the roll paper P and the second cutter 38 provided on the side of the surface opposite from the one surface of the roll paper P shear the roll paper P in cooperation with each other.

Also, this embodiment is characterized in that a clearance is formed between the slider portion 31 of the cutter unit 30 and the guide rail 25, and the cutters (37, 38) receive a force in one direction toward the upstream side or toward the downstream side in terms of the feeding direction of the roll paper P on the basis of the "cutting characteristic" described above.

First Modification

Figure 13:
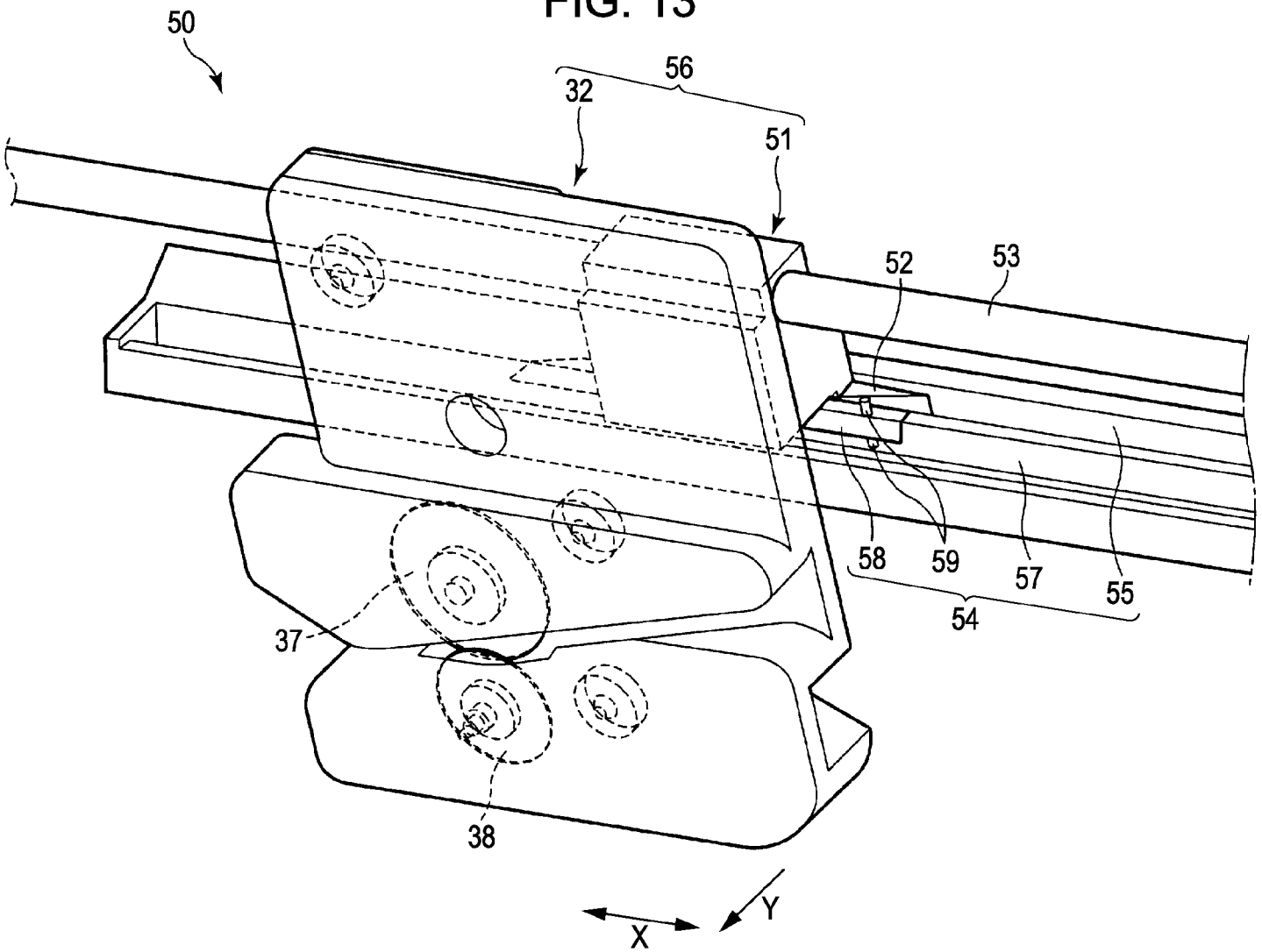
FIG. 13 is a perspective view of the cutting unit according to a first modification.

FIG. 13 is a perspective view showing the side of the eightieth column of the cutting unit according to a first modification.

As shown in FIG. 13, a cutting unit 50 in the first modification includes a cutter unit 56, a guide shaft 53, and a cutter rail 54. Among others, the cutter unit 56 includes the cutter carriage 32 and a slider portion 51.

The cutter cartridge and so on here are the same as the embodiment described above, they are designated by the same reference numerals and the description is omitted.

The slider portion 51 includes an engaging portion 52 which engages the cutter rail 54. The slider portion 51 includes the cylindrical guide shaft 53 extending in the widthwise direction X of the roll paper P inserted thereto.

The cutter rail 54 includes a first rail 55 extending in the widthwise direction X, a second rail 57 provided in parallel with the first rail 55, and a movable wall 58 provided between the first rail 55 and the second rail 57.

Among others, the first rail 55 is provided so as to guide the engaging portion 52 in the outward route of the cutter unit 56 moving from the side of the first column to the side of the eightieth column, that is, when shearing the roll paper P. Also, the second rail 57 is provided so as to guide the engaging portion 52 in the homeward route of the cutter unit 56 moving from the side of the eightieth column to the side of the first column, that is, when returning to the home position after having sheared the roll paper P.

In addition, the movable wall 58 is provided so as to be pivotable about shaft portions 59 and 59, and is urged to the posture which isolates the first rail 55 from the second rail 57 by an urging spring, not shown, that is, to a closed state.

The movable portions are each provided on the eighties column side and the side of the first column. In other words, the structure of the cutter rail 54 on the side of the eightieth column shown in FIG. 13 is also provided on the side of the first column in the same manner symmetrically about a point.

The operation of the cutting unit 50 will be described below.

Figure 14:
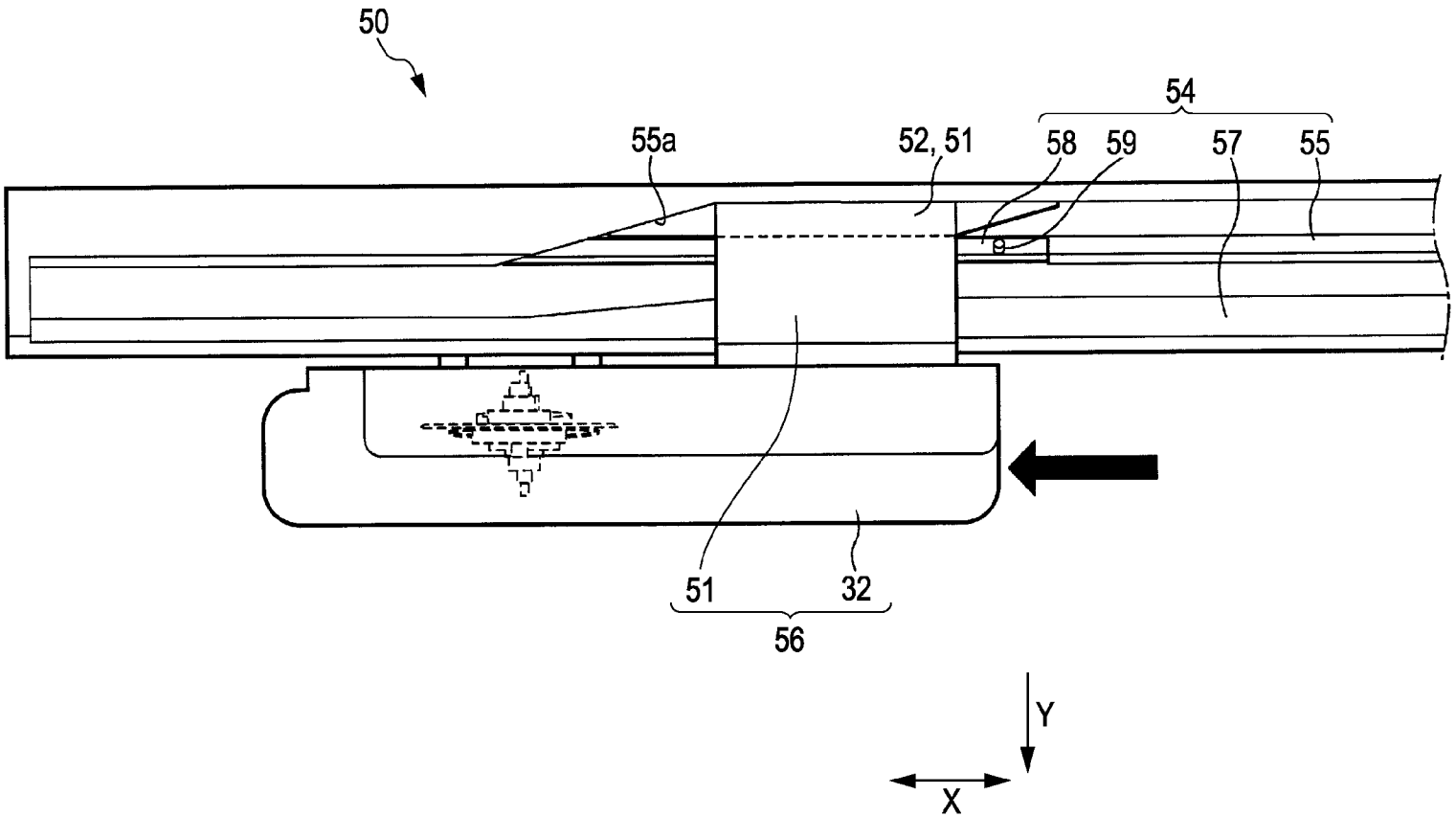
FIG. 14 is a plan view showing the cutting unit according to the first modification (outward route).
Figure 15:
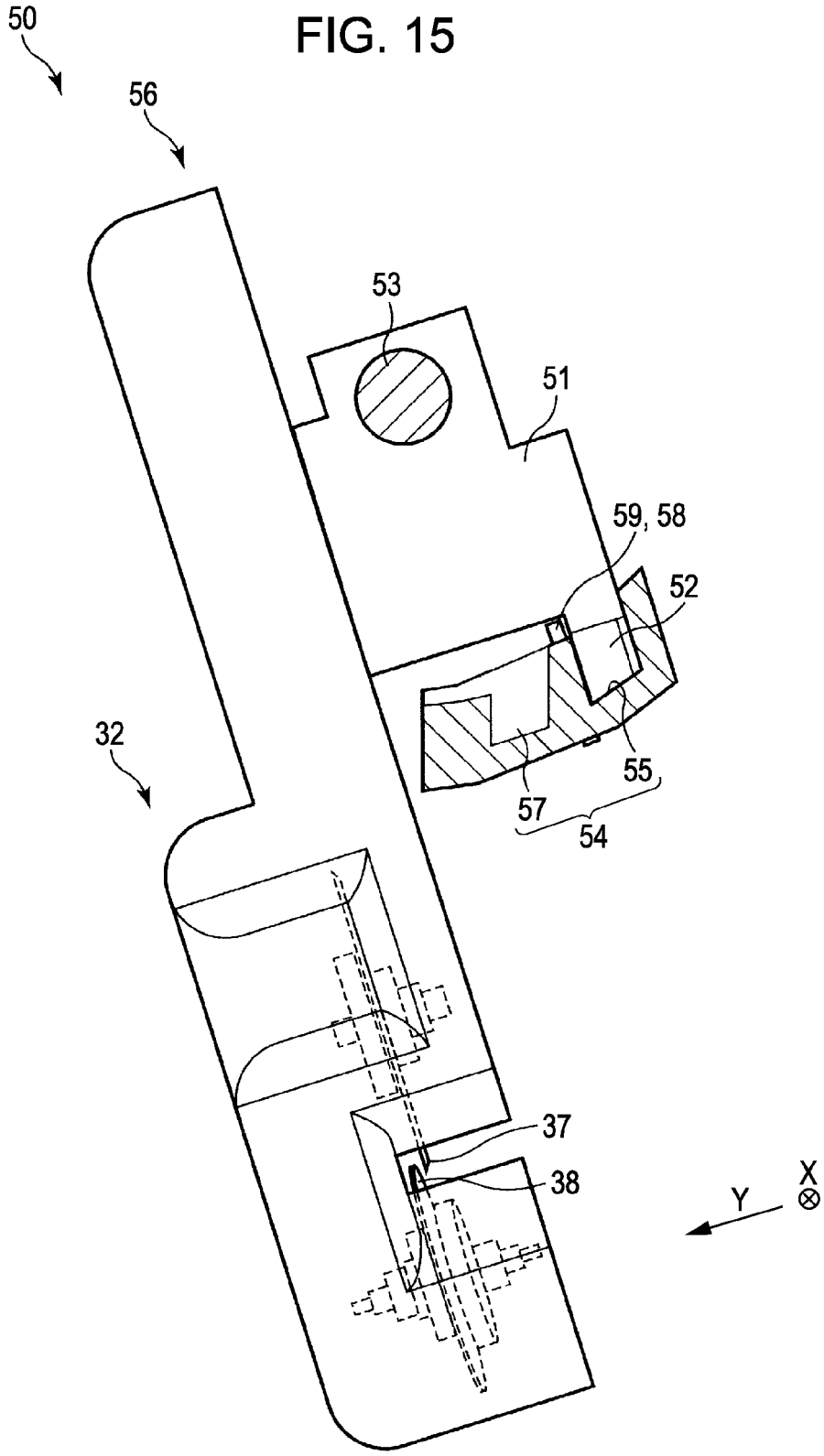
FIG. 15 is a side cross-sectional view showing the position and the posture of the cutter unit in the state shown in FIG. 14.

FIG. 14 is a plan view of the cuter unit in the outward route according to the first modification. FIG. 15 is a side cross-sectional view showing the position and the posture of the cutter unit in the state shown in FIG. 14.

As shown in FIG. 14 and FIG. 15, the engaging portion 52 of the slider portion 51 slides toward the side of the eightieth column while being guided by the first rail 55 of the cutter rail 54 in the outward route for shearing the roll paper P. Then, after having sheared, the engaging portion 52 comes into abutment with an inclined portion 55*a* formed at the end on the side of the eightieth column of the first rail 55.

Figure 16:
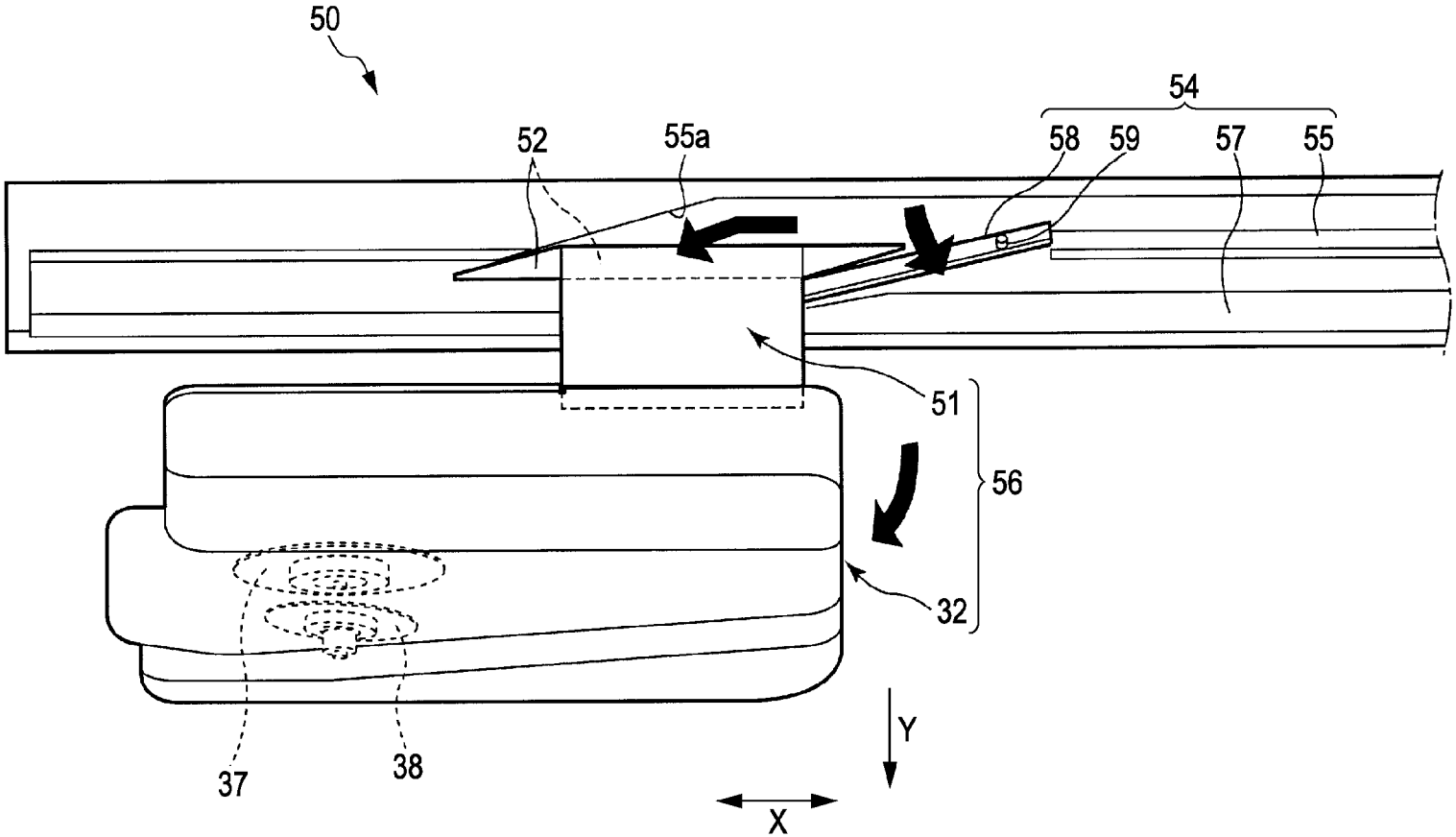
FIG. 16 is a plan view showing the cutting unit according to the first modification (during changeover).

FIG. 16 is a plan view showing a state when the rail at the engaging portion is being changed according to the first modification.

As shown in FIG. 16, when the cutter unit 56 is moved further toward the eightieth column side from the state shown in FIG. 14 and FIG. 15, the engaging portion 52 is guided toward the movable wall by the inclined portion 55*a*. In other words, the inclined portion 55*a* converts part of the force of the cutter unit 56 moving toward the side of the eightieth column into a force of the engaging portion 52 to move toward the downstream side in terms of the feeding direction. In other words, the engaging portion 52 is able to bring the movable wall 58 into an opened state against the urging force of an urging spring, not shown. In other words, the engaging portion 52 is able to open the movable wall 58 to release the state of partitioning between the first rail 55 and the second rail 57.

Figure 17:
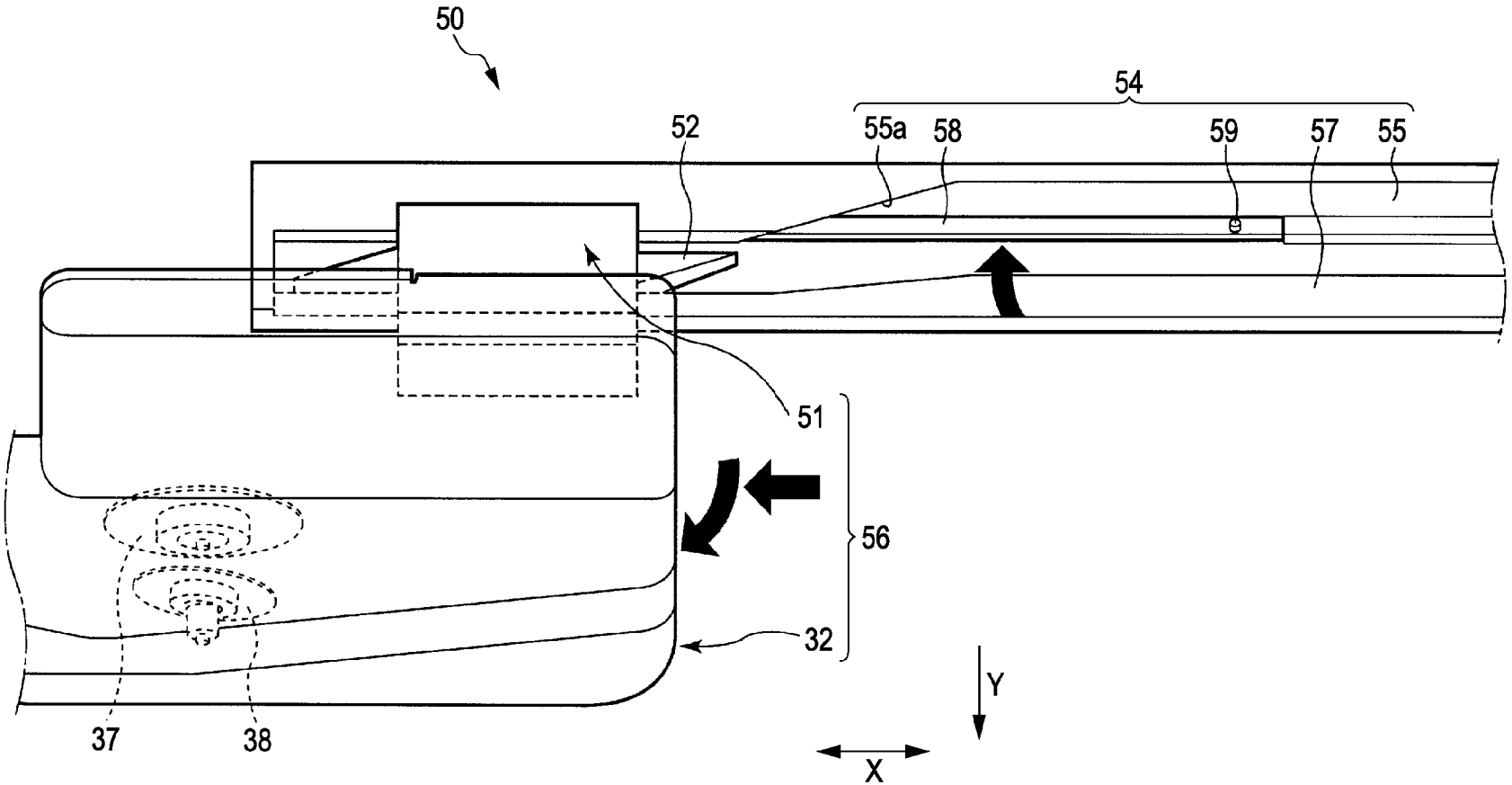
FIG. 17 is a plan view showing the cutting unit according to the first modification (immediately after changeover).
Figure 18:
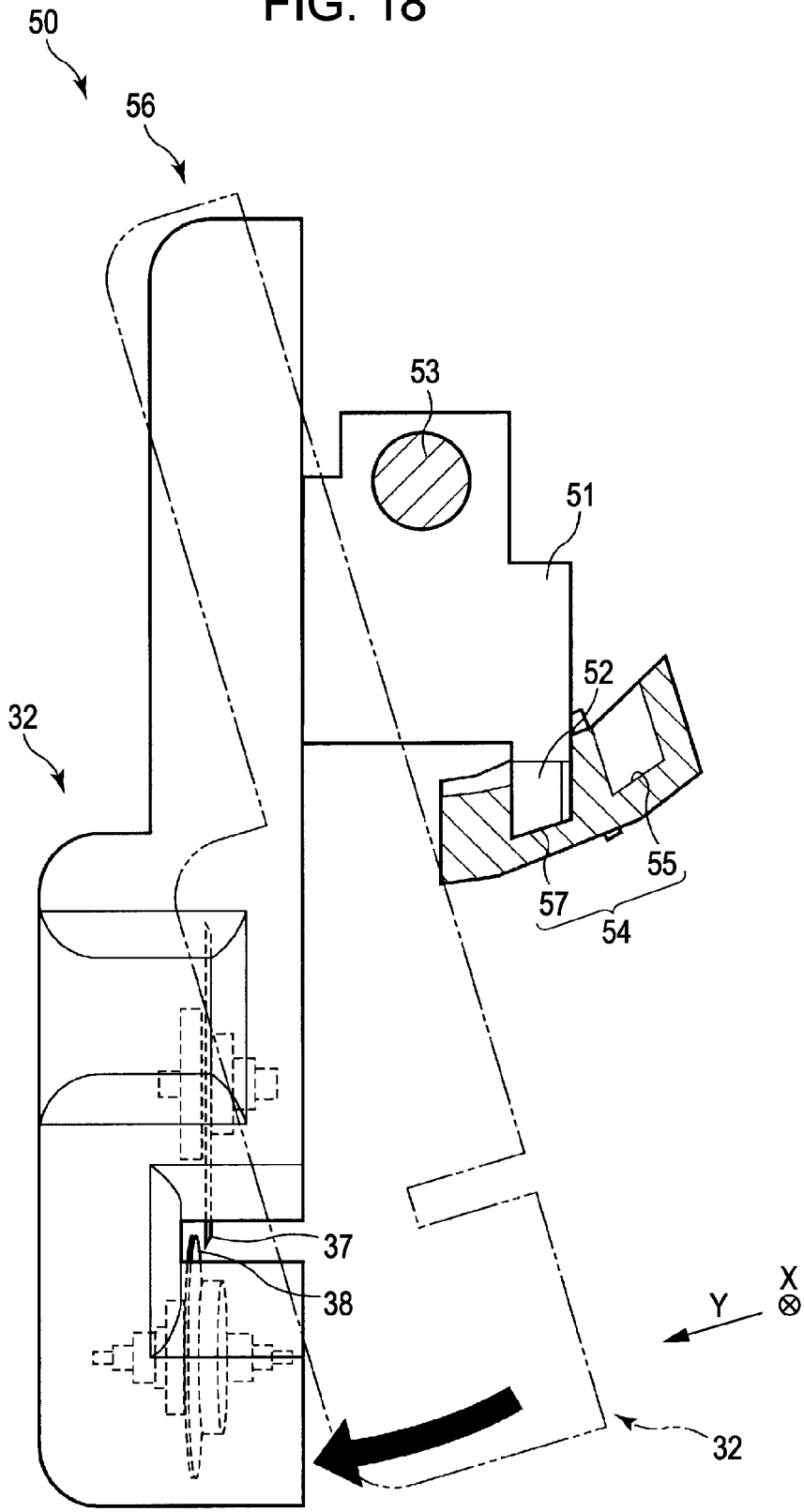
FIG. 18 is a side cross-sectional view showing the position and the posture of the cutter unit in the state shown in FIG. 17.

FIG. 17 is a plan view showing a state immediately after the changeover of the rails at the engaging portion according to the first modification. FIG. 18 is a side cross-sectional view showing the position and the posture of the cutter unit in the state shown in FIG. 17.

As shown in FIG. 17 and FIG. 18, when the cutter unit 56 is moved further toward the eightieth column side from the state shown in FIG. 16, the engaging portion 52 is guided toward the second rail 57 by the inclined portion 55*a*.

At this time, the posture of the cutter unit 56 is shifted clockwise in FIG. 18 about the guide shaft 53. Therefore, the positions of the first cutter 37 and the second cutter 38 are shifted toward the downstream side in terms of the feeding direction. In other words, the first cutter 37 and the second cutter 38 move in the directions away from the downstream end of the sheared upstream roll paper P3.

When the engaging portion 52 is completely moved to the second rail 57, the engaging portion 52 moves away from the movable wall 58. Therefore, the movable wall 58 is brought into a closed state again by the urging force of the urging spring, not shown.

Figure 19:
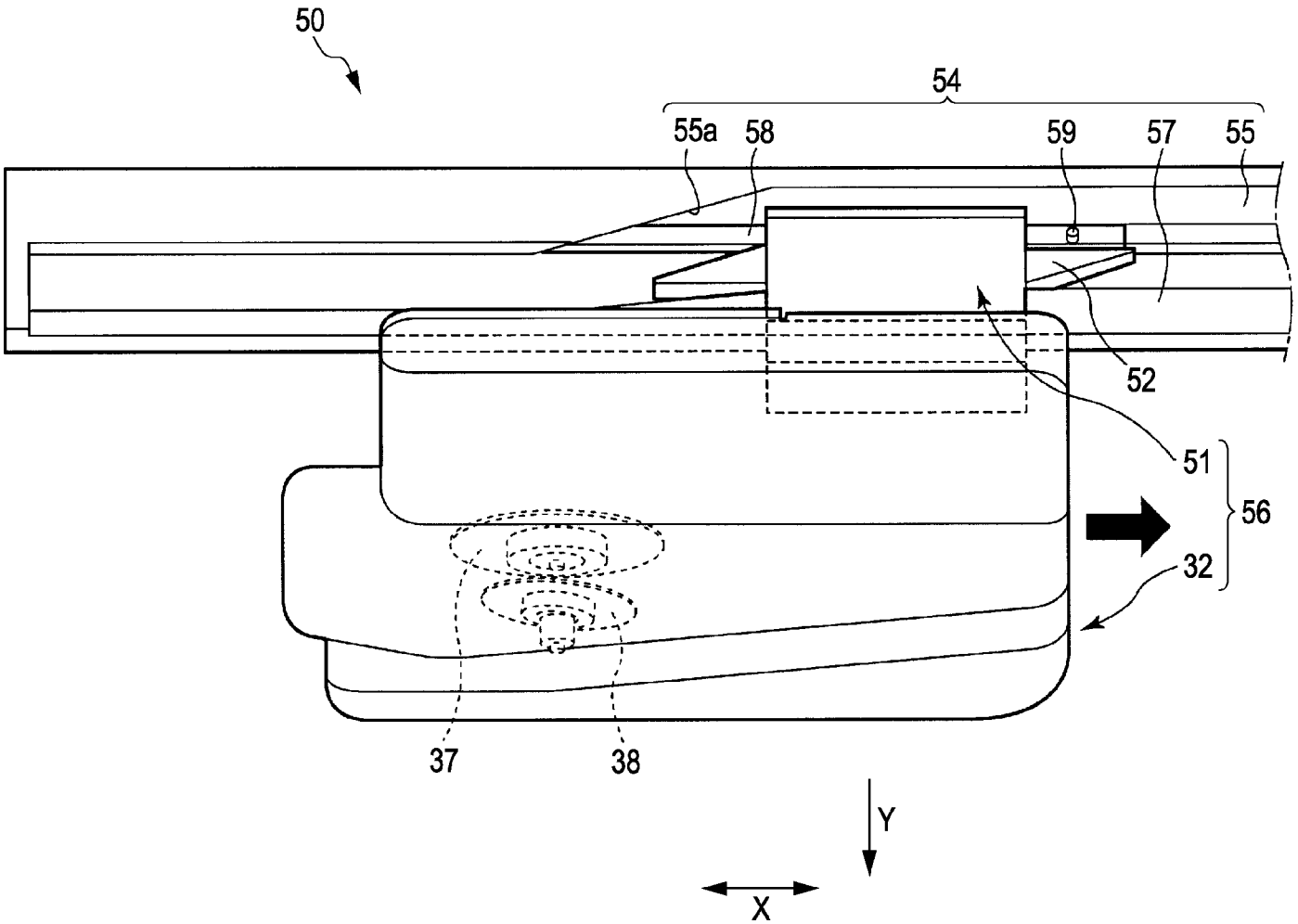
FIG. 19 is a plan view showing the cutting unit according to the first modification (homeward route).

FIG. 19 is a plan view of the cuter unit in the homeward route according to the first modification.

As shown in FIG. 19, when the cutter unit 56 is moved from the side of the eightieth column to the side of the first column, the engaging portion 52 passes through the movable wall 58 in the state of being guided by the second rail 57. Therefore, the posture of the cutter unit 56 is moved in the state shown in FIG. 18. Then, as described above, the movable wall 58 is provided on the side of the first column symmetrically with the side of the eightieth column about a point. In other words, the first rail 55 and the second rail 57 are configured in a loop shape. Therefore, when the engaging portion 52 reaches the end of the second rail 57 on the side of the first column, it is guided to the first rail 55 by an inclined portion (not shown). Consequently, the posture of the cutter unit 56 can be returned to the state shown in FIG. 15.

As described above, by providing the first rail 55 and the second rail 57, the outward routes of the first cutter 37 and the second cutter 38 for the shearing operation and the homeward routes of the first cutter 37 and the second cutter 38 for returning to the home positions are differentiated. Consequently, the first cutter 37 and the second cutter 38 are prevented from cutting the upstream roll paper P3 in the homeward route, that is, from so-called duplex cutting.

The first modification is effective when the feeding direction Y is substantially horizontal. It is also effective when there is no action of the cutting characteristic on the cutter or when the action is minute.

The cutting unit 50 as a cutter device according to the first modification is characterized in that the cutter rail 54 which is one of the guide shaft 53 and the cutter rail 54 as the guide unit includes the first rail 55 as a first rail member configured to guide the cutter unit 56 in the outward route and the second rail 57 as a second rail member configured to guide the cutter unit 56 in the homeward route, and the first rail 55 and the second rail 57 are configured in a loop shape.

Second Modification

Figure 20A:
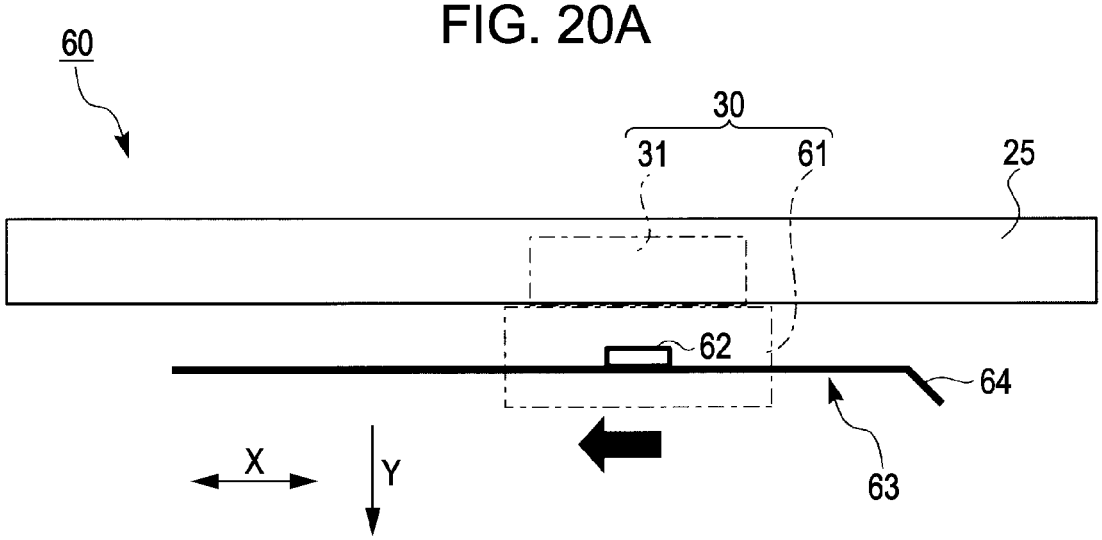
FIG. 20A is a drawing showing the cutting unit according to a second modification (outward route).
Figure 20B:
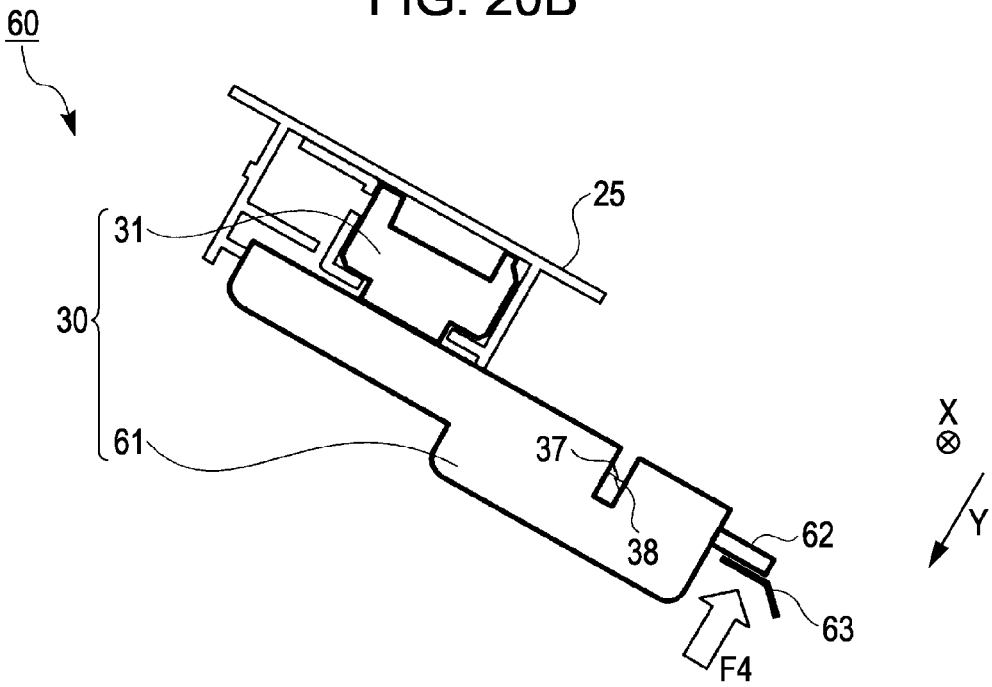
FIG. 20B is a drawing showing the cutting unit according to the second modification (outward route).

FIGS. 20A and 20B are schematic drawings showing the cutter unit in the outward route according to a second modification. FIG. 20A is a schematic plan view. FIG. 20B is a schematic side view.

As shown in FIGS. 20A and 20B, a cutting unit 60 according to the second modification includes a projecting strip 62 provided on a cutter carriage 61, and a first leaf spring 63 as an example of the urging unit provided on the base portion side of the cutting unit 60. The first leaf spring 63 includes a first inclined surface portion 64 on the side of the first column as described later.

Since other members are the same as the embodiment described above, they are designated by the same reference numerals and the description is omitted.

In the outward route of the cutter unit 30, the first leaf spring 63 is provided so as to urge the projecting strip 62 in the upstream side in terms of the feeding direction (urging force F4).

The first leaf spring 63 here extends in the widthwise direction X. Therefore, the cutter unit 30 is able to maintain the posture shown in FIG. 20B in the range opposing the roll paper P in the outward route.

Figure 21A:
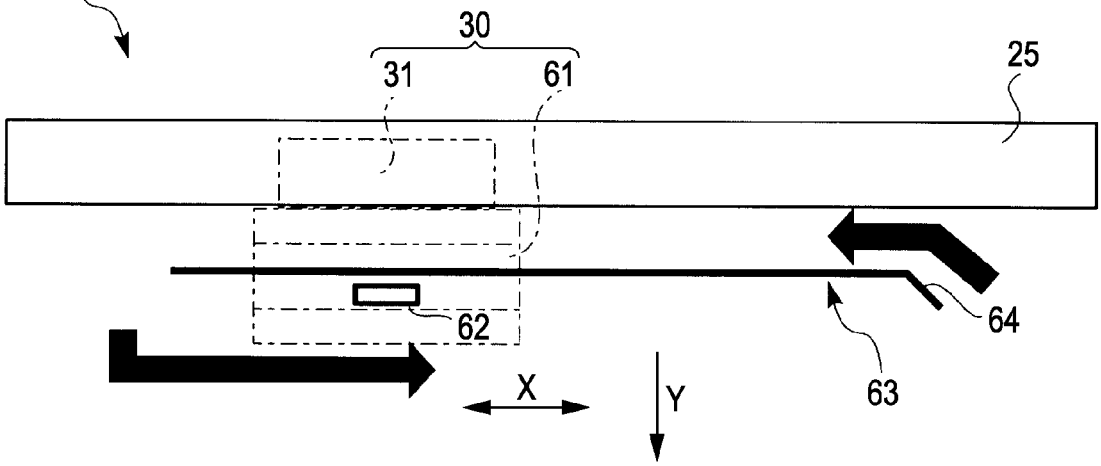
FIG. 21A is a drawing showing the cutting unit according to the second modification (homeward route).
Figure 21B:
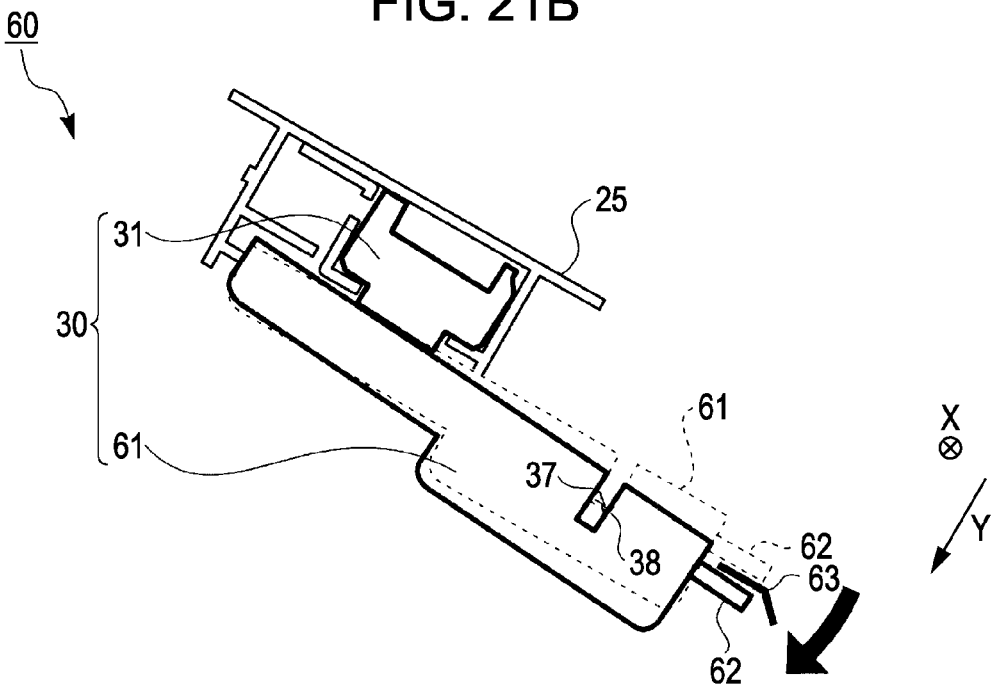
FIG. 21B is a drawing showing the cutting unit according to the second modification (homeward route).

FIGS. 21A and 21B are schematic drawings showing the cutter unit in the homeward route according to the second modification. FIG. 21A is a schematic plan view. FIG. 21B is a schematic side view.

As shown in FIGS. 21A and 21B, the projecting strip 62 moves away from the first leaf spring 63 after the cutter unit 30 has sheared the roll paper P before reaching the eightieth columns side end within the range of the movement of the cutter unit 30 in the widthwise direction. In other words, the cutter unit 30 is brought into a state of not receiving the urging force F4 from the first leaf spring 63.

A force acts on the cutter unit 30 by its own weight so that the positions of the first cutter 37 and the second cutter 38 are shifted to the downstream side in terms of the feeding direction within the range of the rattling generated between the slider portion 31 and the guide rail 25 described above.

Therefore, the posture of the cutter unit 30 is shifted so that the projecting strip 62 is located on the downstream side from the first leaf spring 63 in terms of the feeding direction at the end on the side of the eightieth column within the range of the movement of the cutter unit 30 in the widthwise direction. Then, the cutter unit 30 is moved from the side of the eightieth column to the side of the first column in the posture as described above. Then, the projecting strip 62 presses the first inclined surface portion 64 of the first leaf spring 63 upward and passes therethrough immediately before reaching the end on the side of the first column within the range of the movement of the cutter unit 30 in the widthwise direction. When the cutter unit 30 is in the outward route again, the projecting strip 62 is guided to climb the first inclined surface portion 64, thereby receiving the urging force F4 of the first leaf spring 63 as in FIGS. 20A and 20B.

As described above, by utilizing the urging force F4 of the first leaf spring 63, the outward routes of the first cutter 37 and the second cutter 38 for the shearing operation and the homeward routes of the first cutter 37 and the second cutter 38 for returning to the home positions are differentiated. Consequently, the first cutter 37 and the second cutter 38 are prevented from cutting the upstream roll paper P3 in the homeward route, that is, from so-called duplex cutting.

Here, by configuring the direction of the own weight of the cutter unit 30 which acts thereon to be the opposite direction from the direction in which the urging force F4 of the first leaf spring 63 acts, the outward route and the homeward route are differentiated further reliably.

The cutting unit 60 as the cutter device in the second modification is characterized in that the clearance is provided between the slider portion 31 of the cutter unit 30 and the guide rail 25, and the first leaf spring 63 as an example of the urging unit which urges the cutter unit 30 in one direction toward the upstream side or toward the downstream side in terms of the feeding direction Y only in one of the outward route and the homeward route.

Third Modification

Figure 22A:
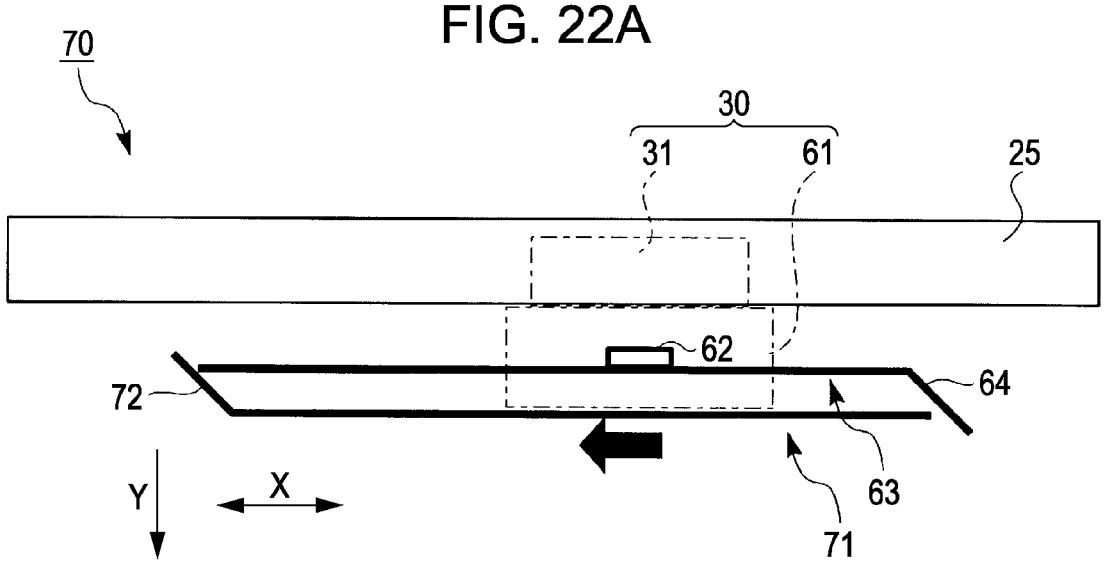
FIG. 22A is a drawing showing the cutting unit according to a third modification (outward route).
Figure 22B:
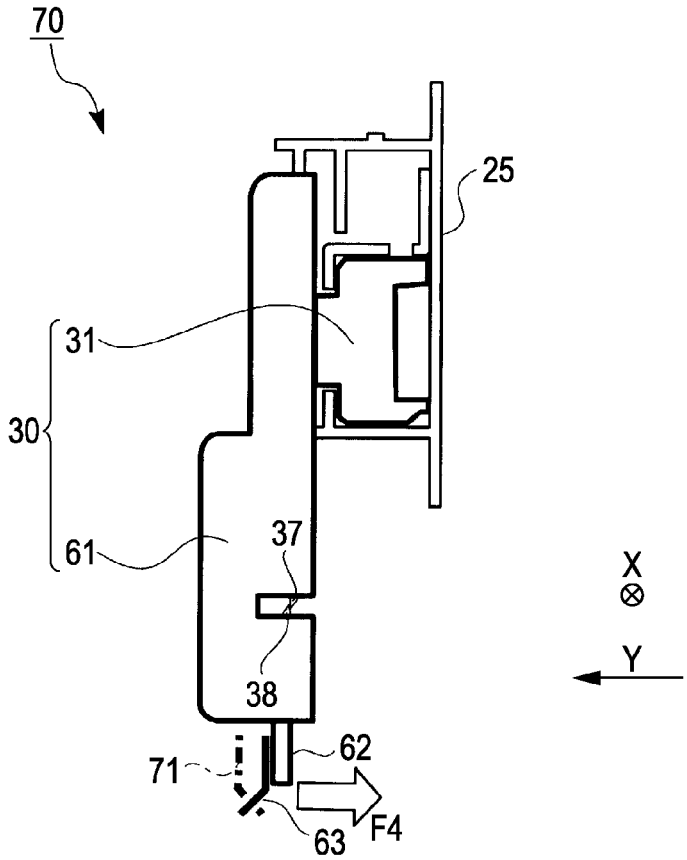
FIG. 22B is a drawing showing the cutting unit according to the third modification (outward route).

FIGS. 22A and 22B are schematic drawings showing the cutter unit in the outward route according to a third modification. FIG. 22A is a schematic plan view. FIG. 22B is a schematic side view.

As shown in FIGS. 22A and 22B, a cutting unit 70 according to the third modification includes the projecting strip 62, the first leaf spring 63, and a second leaf spring 71 as an example of the urging unit provided on the base portion side of the cutting unit 70. The second leaf spring 71 includes a second inclined surface portion 72 on the side of the eightieth column as described later.

Since other members are the same as the embodiment described above, they are designated by the same reference numerals and the description is omitted.

In the outward route of the cutter unit 30, the first leaf spring 63 is provided so as to urge the projecting strip 62 in the upstream side in terms of the feeding direction (urging force F4).

The first leaf spring 63 here extends in the widthwise direction X. Therefore, the cutter unit 30 is able to maintain the posture shown in FIG. 22B in the range opposing the roll paper P in the outward route.

Figure 23A:
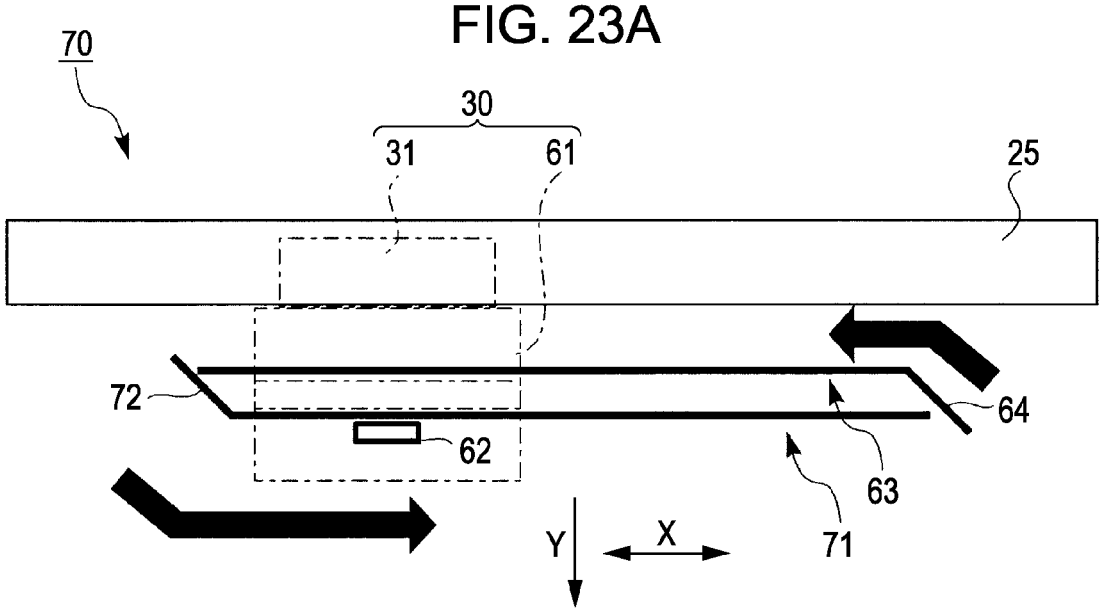
FIG. 23A is a drawing showing the cutting unit according to the third modification (homeward route).
Figure 23B:
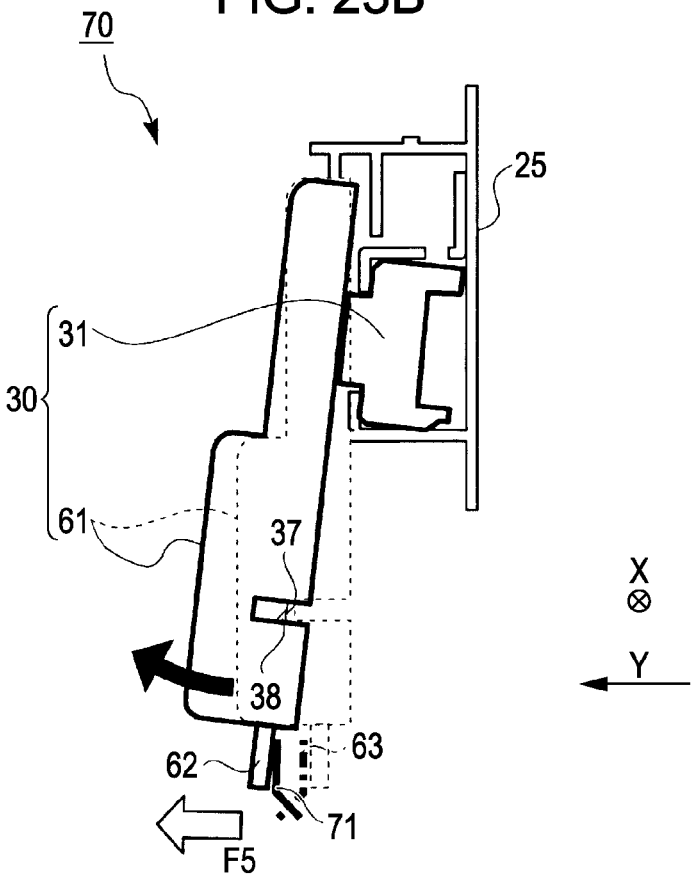
FIG. 23B is a drawing showing the cutting unit according to the third modification (homeward route).

FIGS. 23A and 23B are schematic drawings showing the cutter unit in the homeward route according to the third modification. FIG. 23A is a schematic plan view. FIG. 23B is a schematic side view.

As shown in FIGS. 23A and 23B, the projecting strip 62 pushes the second inclined surface portion 72 of the second leaf spring 71 upward and passes therethrough after the cutter unit 30 has sheared the roll paper P immediately before reaching the eightieth columns side end within the range of widthwise movement of the cutter unit 30.

When the cutter unit 30 starts to move from the side of the eightieth column toward the side of the first column, the projecting strip 62 is guided to climb the second inclined surface portion 72, thereby receiving an urging force F5 of the second leaf spring 71 as in FIGS. 23A and 23B. Therefore, the posture of the cutter unit 30 is shifted so that the projecting strip 62 is located on the downstream side from the second leaf spring 71 in terms of the feeding direction near the end on the side of the eightieth column. Then, the cutter unit 30 is moved from the side of the eightieth column to the side of the first column in the posture as described above.

Then, when returning to the end on the side of the first column within the range of the movement of the cutter unit 30 in the widthwise direction and immediately before reaching the end on side of the first column, the projecting strip 62 presses the first inclined surface portion 64 of the first leaf spring 63 upward and passes therethrough. When the cutter unit 30 is in the outward route again, the projecting strip 62 is guided to climb the first inclined surface portion 64, thereby receiving the urging force F4 of the first leaf spring 63 as in FIGS. 22A and 22B.

Although the first leaf spring 63 and the second leaf spring 71 are provided separately in the modifications described above, they may be provided integrally as a matter of course.

As described above, by utilizing the urging forces (F4, F5) of the first leaf spring 63 and the second leaf spring 71, the outward routes of the first cutter 37 and the second cutter 38 for the shearing operation and the homeward routes of the first cutter 37 and the second cutter 38 for returning to the home positions are differentiated. Consequently, the first cutter 37 and the second cutter 38 are prevented from cutting the upstream roll paper P3 in the homeward route, that is, from so-called duplex cutting.

The third modification is effective when the feeding direction Y is substantially horizontal. It is also effective when there is no action of the cutting characteristic on the cutter or when the action is minute.

The cutting unit 70 as the cutter device in the third modification is characterized in that the clearance is provided between the slider portion 31 of the cutter unit 30 and the guide rail 25, and the first leaf spring 63 and the second leaf spring 71 as examples of the urging unit which urges the cutter unit 30 in one direction toward the upstream side or toward the downstream side in terms of the feeding direction Y in the outward route, and urges the cutter unit 30 in the opposite direction from the one direction in the homeward route.

Fourth Modification

Figure 24A:
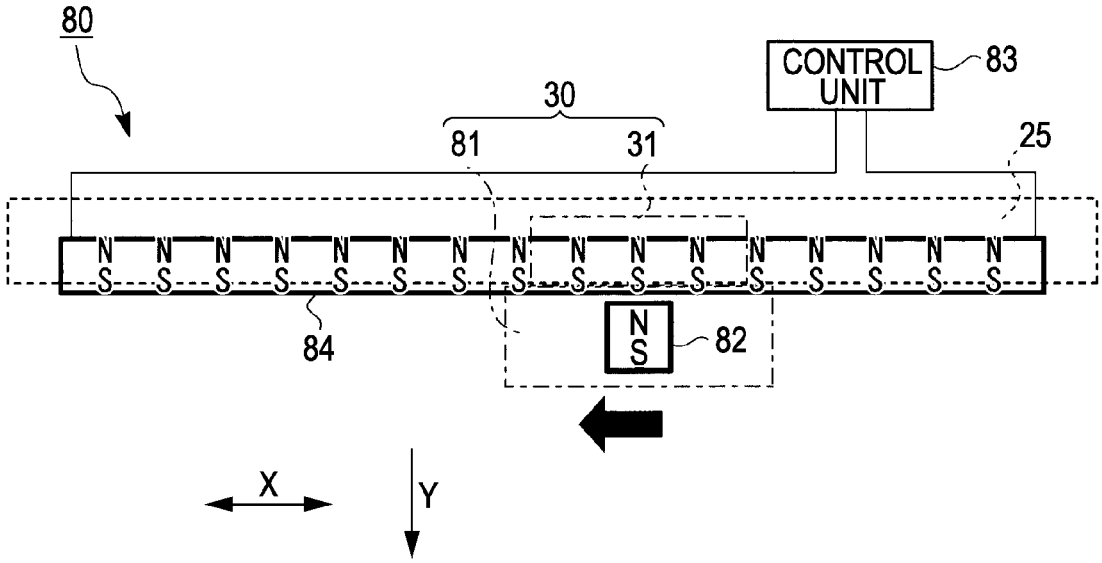
FIG. 24A is a drawing showing the cutting unit according to a fourth modification (outward route).
Figure 24B:
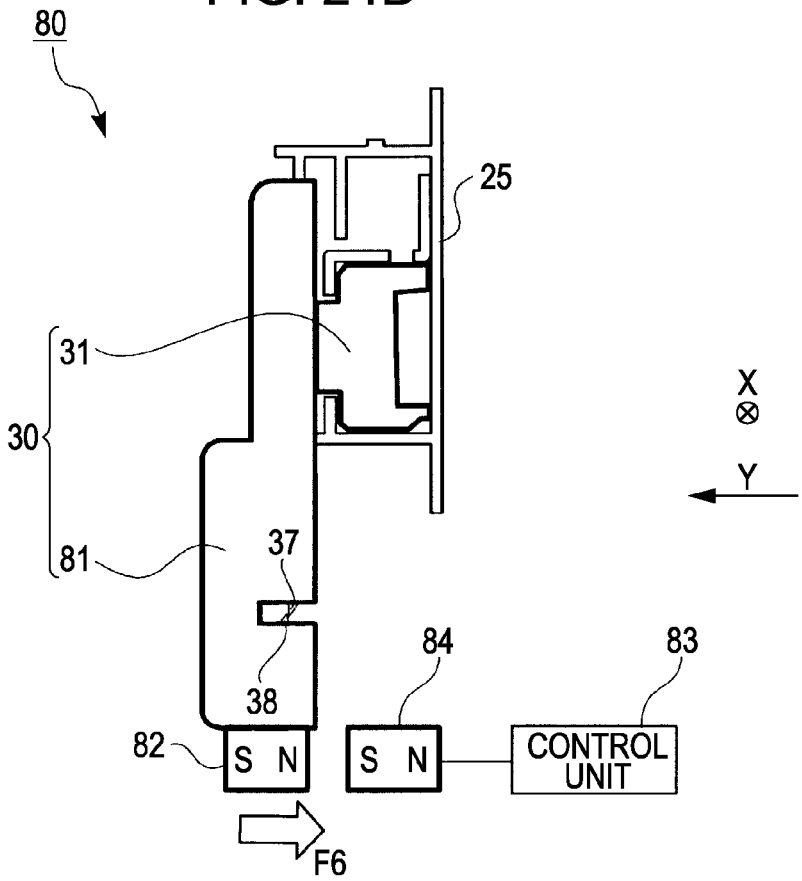
FIG. 24B is a drawing showing the cutting unit according to the fourth modification (outward route).

FIGS. 24A and 24B are schematic drawings showing the cutter unit in the outward route according to a fourth modification. FIG. 24A is a schematic plan view. FIG. 24B is a schematic side view.

As shown in FIGS. 24A and 24B, a cutting unit 80 according to the fourth modification includes a magnet 82 provided on a cutter carriage 81, an electromagnetic coil portion 84 as a magnetic force generating portion as an example of the urging unit provided on the base portion side of the cutting unit 80, and a control unit 83 configured to control the electromagnetic coil portion 84.

The magnet 82 is disposed to have N-pole on the upstream side and S-pole on the downstream side in terms of the feeding direction. In the outward route, the control unit 83 is provided so as to distribute electricity to the electromagnetic coil portion 84 to have N-pole on the upstream side and S-pole on the downstream side in terms of the feeding direction. Therefore, an attracting force F6 is generated between the electromagnetic coil portion 84 and the magnet 82.

The electromagnetic coil portion 84 here is provided so as to extend in the range opposing the roll paper P. Therefore, when it is in the outward route, the attracting force F6 always acts on the cutter unit 30. Specifically, since the electromagnetic coil portion 84 is fixed, the force F6 to pull the cutter unit 30 acts thereon. Consequently, the cutter unit 30 is able to maintain the posture shown in FIG. 24B in the outward route.

Figure 25A:
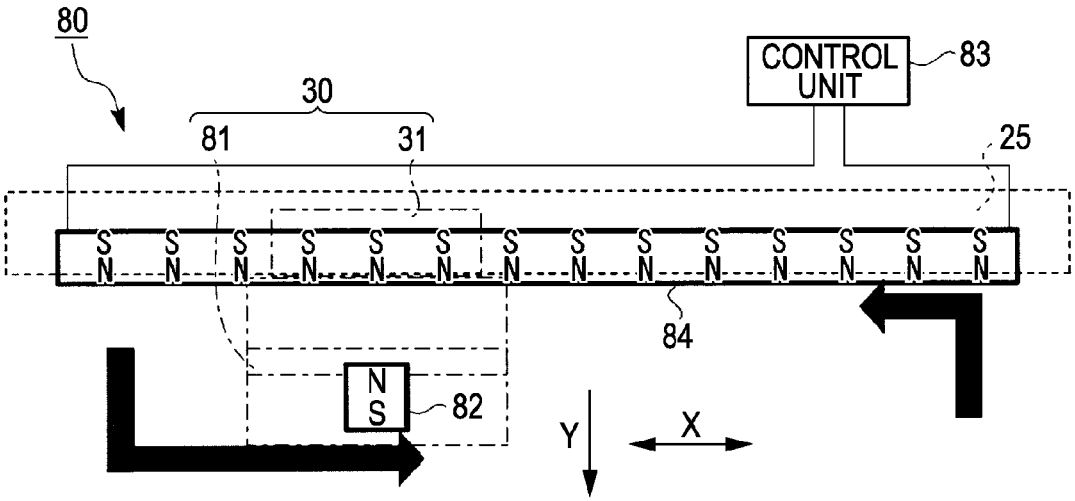
FIG. 25A is a drawing showing the cutting unit according to the fourth modification (homeward route).
Figure 25B:
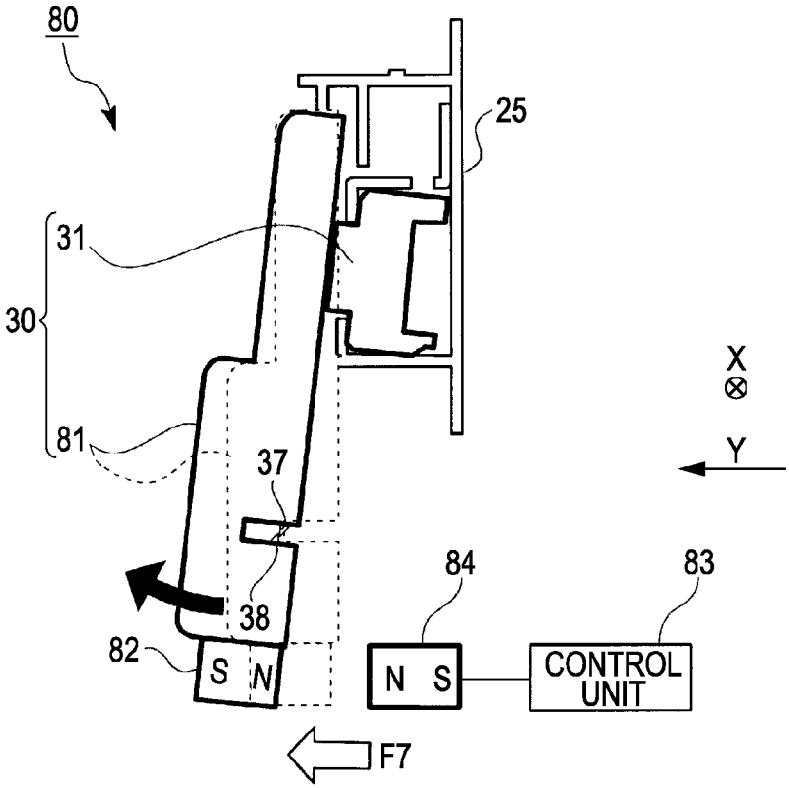
FIG. 25B is a drawing showing the cutting unit according to the fourth modification (homeward route).

FIGS. 25A and 25B are schematic drawings showing the cutter unit in the homeward route according to the fourth modification. FIG. 25A is a schematic plan view. FIG. 25B is a schematic side view.

As shown in FIGS. 25A and 25B, when the cutter unit 30 reaches the end on the side of the eightieth column within the range of the movement of the cutter unit 30 in the widthwise direction after the cutter unit 30 has sheared the roll paper P, the control unit 83 switches the direction of the magnetic force of the electromagnetic coil portion 84 to the opposite direction. In other words, it switches the polarity to S-pole on the upstream side and N-pole on the downstream side in terms of the feeding direction. Therefore, a repulsing force F7 is generated between the electromagnetic coil portion 84 and the magnet 82.

Therefore, the posture of the cutter unit 30 is shifted so that the magnet 82 is moved toward the downstream side in terms of the feeding direction at the end on the side of the eightieth column within the range of the movement of the cutter unit 30 in the widthwise direction. Then, the cutter unit 30 is moved from the side of the eightieth column to the side of the first column in the posture as described above. When the cutter unit 30 is further moved and is in the outward route again, the control unit 83 switches the direction of the magnetic force of the electromagnetic coil portion 84 again. Therefore, the attracting force F6 is caused to act again.

Although the electromagnetic coil portion 84 is provided on one of the upstream side and the downstream side of the magnet 82 in terms of the feeding direction in the fourth modification, it may be provided on both sides as a matter of course. In such a case, it is not necessary to switch the direction of the magnetic force, and only the switching between ON and OFF is necessary. Alternatively, a metallic strip is also applicable instead of the magnet 82.

As described above, by utilizing the magnetic forces (F6, F7), the outward routes of the first cutter 37 and the second cutter 38 for the shearing operation and the homeward routes of the first cutter 37 and the second cutter 38 for returning to the home positions are differentiated. Consequently, the first cutter 37 and the second cutter 38 are prevented from cutting the upstream roll paper P3 in the homeward route, that is, from so-called duplex cutting.

The fourth modification is effective when the feeding direction Y is substantially horizontal. It is also effective when there is no action of the cutting characteristic on the cutter or when the action is minute.

The cutting unit 80 as the cutter device according to the fourth modification is characterized in that the urging unit which urges the cutter unit 30 in one direction toward the upstream side or toward the downstream side in terms of the feeding direction Y in the outward route, and urges the cutter unit 30 in the direction opposite from the one direction in the homeward route includes the electromagnetic coil portion 84 as an example of the magnetic force generating portion which generates a magnetic force to shift the posture of the cutter unit 30 or the position thereof in terms of the feeding direction Y.

The printer 1 as the printing apparatus in the embodiments of this application is characterized by including the roll paper feeding unit 3 as a feeder configured to feed the roll paper P as an example of the printing medium, the print executing unit 4 as a printing unit configured to carry out the printing operation on the roll paper P fed from the roll paper feeding unit 3 by the printhead 12, and the cutting units 20, 50, 60, 70, or 80 configured to cut the printed roll paper P.

The invention is not limited to the embodiment described above, and various modifications are possible within the scope of the invention claimed in attached Claims and such modifications are also included within the scope of the invention as a matter of course.

What is claimed is:

1. A cutter device comprising:

a cutter configured to cut a material to be cut, the material including an upstream part and a downstream part after cutting the material to be cut into parts;

a carriage having the cutter and moving in a widthwise direction with respect to a feeding direction of the material to be cut; and a guide unit configured to guide the carriage in the widthwise direction, wherein, assuming that the movement of the carriage when the cutter cuts the material to be cut is an outward route, the guide unit is configured to change a posture of the carriage such that a homeward route of the cutter of the carriage is different from the outward route of the cutter, wherein the change in the posture shifts the homeward route of the cutter of the carriage from the outward route toward the downstream part which moves first in a direction away from the upstream part in the feeding direction after the cutting.

2. The cutter device according to claim 1, wherein the cutter includes a first cutter provided on the side of one surface of the material to be cut and a second cutter provided on the side opposite from the side of the one surface of the material to be cut, and shears the material to be cut by the cooperation of the first cutter and the second cutter.

3. The cutter device according to claim 1, wherein a clearance is formed between the carriage and the guide unit, and the cutter receives a force in one direction toward the upstream side or the downstream side in the feeding direction of the material to be cut on the basis of the cutting characteristic.

4. The cutter device according to claim 1, wherein the guide unit includes a first rail member configured to guide the carriage in the outward route and a second rail member configured to guide the carriage in the homeward route, and the first rail member and the second rail member are configured into a loop shape.

5. The cutter device according to claim 1, wherein a clearance is formed between the carriage and the guide unit, and an urging unit configured to urge the carriage in one direction toward the upstream side or the downstream side in the feeding direction in only one of the outward route and the homeward route is provided.

6. The cutter device according to claim 1, wherein a clearance is provided between the carriage and the guide unit, and an urging unit configured to urge the carriage in one direction toward the upstream side or the downstream side in the feeding direction in the outward route and urge the carriage in the direction opposite from the one direction in the homeward route is provided.

7. The cutter device according to claim 5, wherein the urging means includes a magnetic force generating portion that configures to generate a magnetic force, and shifts the posture of the carriage or the position in the feeding direction.

8. A printing apparatus comprising:

a feeder that configures to feed a printing medium;

a printing unit configured to carry out a printing job on the printing medium fed from the feeder by a printhead; and a cutting unit configured to cut the printed printing medium, wherein the cutting unit includes a cutter device according to claim 1.

* * * * *